US011333410B2

(12) United States Patent
Kojima

(10) Patent No.: US 11,333,410 B2
(45) Date of Patent: May 17, 2022

(54) REFRIGERATION APPARATUS

(71) Applicant: Daikin Industries, LTD., Osaka (JP)

(72) Inventor: Akiharu Kojima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 7 days.

(21) Appl. No.: 16/619,303

(22) PCT Filed: Jul. 17, 2018

(86) PCT No.: PCT/JP2018/026763
§ 371 (c)(1),
(2) Date: Dec. 4, 2019

(87) PCT Pub. No.: WO2019/017350
PCT Pub. Date: Jan. 24, 2019

(65) Prior Publication Data

US 2020/0149785 A1 May 14, 2020

(30) Foreign Application Priority Data

Jul. 20, 2017 (JP) ..... JP2017-141340

(51) Int. Cl.
*F25B 13/00* (2006.01)
*F25B 49/02* (2006.01)
*F25B 1/00* (2006.01)

(52) U.S. Cl.
CPC ..... *F25B 13/00* (2013.01); *F25B 49/02* (2013.01); *F25B 1/00* (2013.01);
(Continued)

(58) Field of Classification Search
CPC .. F25B 13/00; F25B 49/02; F25B 1/00; F25B 2313/0231; F25B 2313/02741;
(Continued)

(56) References Cited

U.S. PATENT DOCUMENTS 5,603,222 A * 2/1997 Dube ..... F04B 39/06 62/469
9,194,619 B2 * 11/2015 Margotti ..... F25B 31/006
(Continued)

FOREIGN PATENT DOCUMENTS

EP 1 826 509 A2 8/2007
JP H01266471 A * 10/1989
(Continued)

OTHER PUBLICATIONS

Sakazume et al., Refrigerator, Oct. 24, 1989, JPH01266471A, Whole Document (Year: 1989).*

*Primary Examiner* — Larry L Furdge
(74) *Attorney, Agent, or Firm* — Birch, Stewart, Kolasch & Birch, LLP

(57) ABSTRACT

The invention provides a refrigeration apparatus configured to cool the interior of a casing of a heat source unit by a refrigerant. An air conditioner includes a heat source unit, a utilization unit having a utilization heat exchanger and constituting a refrigerant circuit along with the heat source unit, and a controller. The heat source unit causes heat exchange between a refrigerant and a heat source, and cools the interior of the casing, and causes a valve to switch to supply or not to supply the cooling heat exchanger with the refrigerant. The controller assesses, before the refrigerant is supplied to the cooling heat exchanger, whether or not the refrigerant flowing from the cooling heat exchanger toward the compressor comes into a wet state when the refrigerant is supplied, and determines whether or not to open the valve in accordance with an assessment result.

7 Claims, 13 Drawing Sheets

(52) U.S. Cl.
CPC ..... *F25B 2313/0231* (2013.01); *F25B 2313/02741* (2013.01); *F25B 2313/0315* (2013.01); *F25B 2600/2513* (2013.01); *F25B 2700/1931* (2013.01)

(58) Field of Classification Search
CPC ..... F25B 2313/0315; F25B 2600/2513; F25B 2700/1931; F25B 2400/13; F25B 2700/21151; F25B 2700/1933; F25B 2600/2515; F25B 2313/0314; F25B 2313/021; F25B 2313/025; F25B 2313/02732; F25B 2313/007; F25B 2313/004; F25B 41/24
See application file for complete search history.

(56) References Cited

U.S. PATENT DOCUMENTS

| | | | | |
|---|---|---|---|---|
| 2008/0236189 | A1* | 10/2008 | Honda | F25B 13/00 62/468 |
| 2012/0255318 | A1 | 10/2012 | Kido et al. | |
| 2013/0255932 | A1* | 10/2013 | Doepker | F28D 15/00 165/287 |

FOREIGN PATENT DOCUMENTS

| | | | |
|---|---|---|---|
| JP | 8-49884 | A | 2/1996 |
| JP | 9-72625 | A | 3/1997 |
| JP | 10-176869 | A | 6/1998 |
| JP | 2001-99512 | A | 4/2001 |
| WO | WO 2011/077720 | A1 | 6/2011 |

* cited by examiner

REFRIGERATION APPARATUS

TECHNICAL FIELD

The present invention relates to a refrigeration apparatus, particularly to a refrigeration apparatus configured to cool the interior of a casing of a heat source unit by means of a refrigerant.

BACKGROUND ART

A refrigeration apparatus includes a heat source unit having a casing that accommodates equipment such as a compressor and electric components that generate heat while the refrigeration apparatus is in operation. In order to cool these types of equipment, the heat source unit may include a fan to cool the equipment with air supplied from outside the casing and discharge air that has cooled the equipment from the casing (e.g. Patent Literature 1 (JP 8-049884 A)).

However, such ventilation may be insufficient and allow excessive temperature increase in the casing. Particularly in a case where the heat source unit is installed in a room like a machine chamber, the temperature of the machine chamber, into which the air warmed in the casing blows, may also rise and, it may adversely affect a work environment and the like for a worker in the machine chamber.

SUMMARY OF THE INVENTION

Technical Problem

In order to reduce such temperature increase in the casing, the heat source unit may be provided with a heat exchanger (a cooling heat exchanger) configured to cool the interior of the casing in addition to a main heat exchanger configured to cause heat exchange between a heat source and the refrigerant, to cool the interior of the casing by means of a low-temperature refrigerant.

In the case where the refrigerant is supplied to the cooling heat exchanger to cool the interior of the casing, the refrigerant flowing from the cooling heat exchanger to the compressor may come into a wet state under a certain condition to cause liquid compression.

In order to avoid continuous operation of the refrigeration apparatus in such a state, there may be provided various sensors at a suction side of the compressor to detect the wet state of the refrigerant, and the refrigerant may be supplied or may not be supplied to the cooling heat exchanger in accordance with detection results. Such a configuration may have risk of at least temporal liquid compression caused by supply of the refrigerant to the cooling heat exchanger. Therefore, there is room for improvement in terms of reliability of the refrigeration apparatus.

It is an object of the present invention to provide a highly reliable refrigeration apparatus that is configured to cool the interior of a casing of a heat source unit by means of a refrigerant and can reduce a possibility that liquid compression is caused by supply of the refrigerant to a heat exchanger for cooling the interior of the casing.

Solution to Problem

A refrigeration apparatus according to a first aspect of the present invention includes a heat source unit, a utilization unit, and a controller. The heat source unit includes a compressor, a main heat exchanger, a casing, a cooling heat exchanger, and a valve. The compressor compresses a refrigerant. The main heat exchanger causes heat exchange between the refrigerant and a heat source. The casing accommodates the compressor and the main heat exchanger. The cooling heat exchanger is supplied with the refrigerant to cool the interior of the casing. The valve switches to supply or not to supply the cooling heat exchanger with the refrigerant. The utilization unit includes a utilization heat exchanger. The utilization unit and the heat source unit constitute a refrigerant circuit. The controller controls to open or close the valve. The controller assesses, before the valve is opened to supply the cooling heat exchanger with the refrigerant, whether or not the refrigerant flowing from the cooling heat exchanger toward the compressor comes into a wet state when the refrigerant is supplied to the cooling heat exchanger, and determines whether or not to open the valve in accordance with an assessment result.

In the refrigeration apparatus according to the first aspect of the present invention, it is determined whether to open or not to open the valve for switching between supply and non-supply of the refrigerant to the cooling heat exchanger in accordance with the assessment result as to whether or not the refrigerant that flows from the cooling heat exchanger used to cool the interior of the casing toward the compressor will come into the wet state. This configuration thus achieves a highly reliable refrigeration apparatus that can reduce the liquid compression caused by supply of the refrigerant to the cooling heat exchanger.

A refrigeration apparatus according to a second aspect of the present invention is the refrigeration apparatus according to the first aspect, in which the controller assesses whether or not the refrigerant entirely comes into a gaseous state immediately after flowing out of the cooling heat exchanger when the refrigerant is supplied to the cooling heat exchanger, and determines whether or not to open the valve in accordance with an assessment result.

According to this aspect, whether or not to open the valve configured to switch to supply or not to supply the cooling heat exchanger with the refrigerant is determined in accordance with the assessment result as to whether or not the refrigerant entirely comes into the gaseous state immediately after flowing out of the cooling heat exchanger. The refrigeration apparatus thus particularly facilitates reduction of liquid compression caused by supply of the refrigerant to the cooling heat exchanger.

A refrigeration apparatus according to a third aspect of the present invention is the refrigeration apparatus according to the first aspect or the second aspect, further including a first deriving unit and a second deriving unit. The first deriving unit derives first pressure upstream of the valve in a refrigerant flow direction of the refrigerant flowing to the cooling heat exchanger when the valve is opened. The second deriving unit derives second pressure downstream of the cooling heat exchanger in the refrigerant flow direction. The controller determines whether or not to open the valve in accordance with pressure difference between the first pressure and the second pressure.

Each of the first deriving unit and the second deriving unit to derive pressure is not limitedly configured to derive the pressure in accordance with a measurement value of a pressure sensor that directly measures the pressure. Each of the first deriving unit and the second deriving unit may alternatively be configured to calculate pressure in accordance with measured temperature or in accordance with information such as a value of pressure discharged from the compressor or an opening degree of an expansion valve.

According to this aspect, whether or not to open the valve is determined in accordance with the pressure difference between the first pressure and the second pressure correlated with quantity of the refrigerant flowing in the cooling heat exchanger when the valve is opened. This configuration achieves high reliability of the refrigeration apparatus that can reduce the occurrence of liquid compression.

A refrigeration apparatus according to a fourth aspect of the present invention is the refrigeration apparatus according to the third aspect, further including a temperature measurement unit. The temperature measurement unit measures temperature in the casing. The controller determines whether or not to open the valve also in accordance with the temperature.

According to this aspect, whether or not to open the valve is determined in accordance with the pressure difference between the first pressure and the second pressure and also the temperature in the casing correlated with quantity of heat supplied to the refrigerant in the cooling heat exchanger. This configuration achieves high reliability of the refrigeration apparatus that can reduce the occurrence of liquid compression.

A refrigeration apparatus according to a fifth aspect of the present invention is the refrigeration apparatus according to the first aspect, in which the controller assesses whether or not the refrigerant that is obtained after mixing the refrigerant flowing out of the cooling heat exchanger and the refrigerant returning from the utilization unit and that flows toward the compressor comes into the wet state when the refrigerant is supplied to the cooling heat exchanger, and determines whether or not to open the valve in accordance with an assessment result.

According to this aspect, whether or not to open the valve configured to switch to supply or not to supply the cooling heat exchanger with the refrigerant is determined in accordance with the assessment result as to whether or not the refrigerant obtained after mixing the refrigerant flowing out of the cooling heat exchanger and the refrigerant returning from the utilization unit and flowing toward the compressor comes into the wet state. The cooling heat exchanger may thus be possibly supplied with the refrigerant even under a condition where the refrigerant comes into the wet state immediately after flowing out of the cooling heat exchanger. The cooling heat exchanger in the present refrigeration apparatus is accordingly applicable under a wider condition.

A refrigeration apparatus according to a sixth aspect of the present invention is the refrigeration apparatus according to the fifth aspect, further including a first deriving unit and a second deriving unit. The first deriving unit derives first pressure upstream of the valve in a refrigerant flow direction of the refrigerant flowing to the cooling heat exchanger when the valve is opened. The second deriving unit derives second pressure downstream of the cooling heat exchanger in the refrigerant flow direction. The controller determines whether or not to open the valve in accordance with pressure difference between the first pressure and the second pressure and quantity of the refrigerant returning from the utilization unit.

Also in this aspect, each of the first deriving unit and the second deriving unit configured to derive pressure is not limited to one that derives the pressure in accordance with a measurement value of a pressure sensor configured to directly measure the pressure. Each of the first deriving unit and the second deriving unit may alternatively be configured to calculate pressure in accordance with measured temperature or in accordance with information such as a value of pressure discharged from the compressor or an opening degree of an expansion valve.

According to this aspect, whether or not to open the valve is determined in accordance with the pressure difference between the first pressure and the second pressure correlated with quantity of the refrigerant flowing in the cooling heat exchanger when the valve is opened and the quantity of the refrigerant returning from the utilization unit. This configuration thus achieves high reliability of the refrigeration apparatus that can reduce the occurrence of liquid compression.

A refrigeration apparatus according to a seventh aspect of the present invention is the refrigeration apparatus according to the sixth aspect, further including a temperature measurement unit and a superheating degree deriving unit. The temperature measurement unit measures temperature in the casing. The superheating degree deriving unit derives a degree of superheating of the refrigerant returning from the utilization unit. The controller determines whether or not to open the valve further in accordance with the temperature in the casing and the degree of superheating of the refrigerant returning from the utilization unit.

According to this aspect, whether or not to open the valve is determined in accordance with quantity of the refrigerant and also in accordance with the temperature in the casing correlated with the quantity of heat supplied to the refrigerant in the cooling heat exchanger and the degree of superheating of the refrigerant returning from the utilization unit. This configuration achieves high reliability of the refrigeration apparatus that can reduce the occurrence of liquid compression.

A refrigeration apparatus according to an eighth aspect of the present invention is the refrigeration apparatus according to any one of the first to seventh aspects, in which the cooling heat exchanger is disposed on a pipe connecting a pipe connecting between the main heat exchanger and the utilization heat exchanger and a suction pipe of the compressor.

This configuration achieves high reliability of the refrigeration apparatus that can reduce the occurrence of liquid compression caused by the refrigerant flowing from the cooling heat exchanger to the suction pipe.

A refrigeration apparatus according to a ninth aspect of the present invention is the refrigeration apparatus according to any one of the first to eighth aspects, in which the heat source is water.

According to this aspect, the refrigeration apparatus achieves control of the temperature in the casing at predetermined temperature even in a case where the refrigeration apparatus utilizes water as the heat source and is likely to have heat accumulated in the casing of the heat source unit.

Advantageous Effects of Invention

In the refrigeration apparatus according to the first aspect of the present invention, it is determined whether to open or not to open the valve for switching between supply and non-supply of the refrigerant to the cooling heat exchanger in accordance with the assessment result as to whether or not the refrigerant that flows from the cooling heat exchanger used to cool the interior of the casing toward the compressor will come into the wet state. This configuration thus achieves a highly reliable refrigeration apparatus that can reduce the liquid compression caused by supply of the refrigerant to the cooling heat exchanger.

The refrigeration apparatus according to the second aspect of the present invention particularly facilitates reduction of liquid compression caused by supply of the refrigerant to the cooling heat exchanger.

The refrigeration apparatus according to each of the third and fourth aspects of the present invention achieves high reliability.

The refrigeration apparatus according to the fifth aspect of the present invention can use the cooling heat exchanger, under a wider condition, to cool the interior of the casing.

The refrigeration apparatus according to each of the sixth and seventh aspects of the present invention achieves high reliability.

The refrigeration apparatus according to the eighth aspect of the present invention achieves refrigeration apparatus with high reliability that can reduce the occurrence of liquid compression caused by the refrigerant flowing from the cooling heat exchanger into the suction pipe.

The refrigeration apparatus according to the ninth aspect of the present invention achieves control of the temperature in the casing at the predetermined temperature even in the case where the refrigeration apparatus utilizes water as the heat source and is likely to have heat accumulated in the casing of the heat source unit.

DESCRIPTION OF EMBODIMENTS

A refrigeration apparatus according to an embodiment of the present invention will be described hereinafter with reference to the drawings. The embodiment and modification examples to be described hereinafter merely exemplify the present invention without limiting the technical scope of the present invention, and can be appropriately modified within the range not departing from the purpose of the present invention.

(1) Entire Configuration

Figure 1:
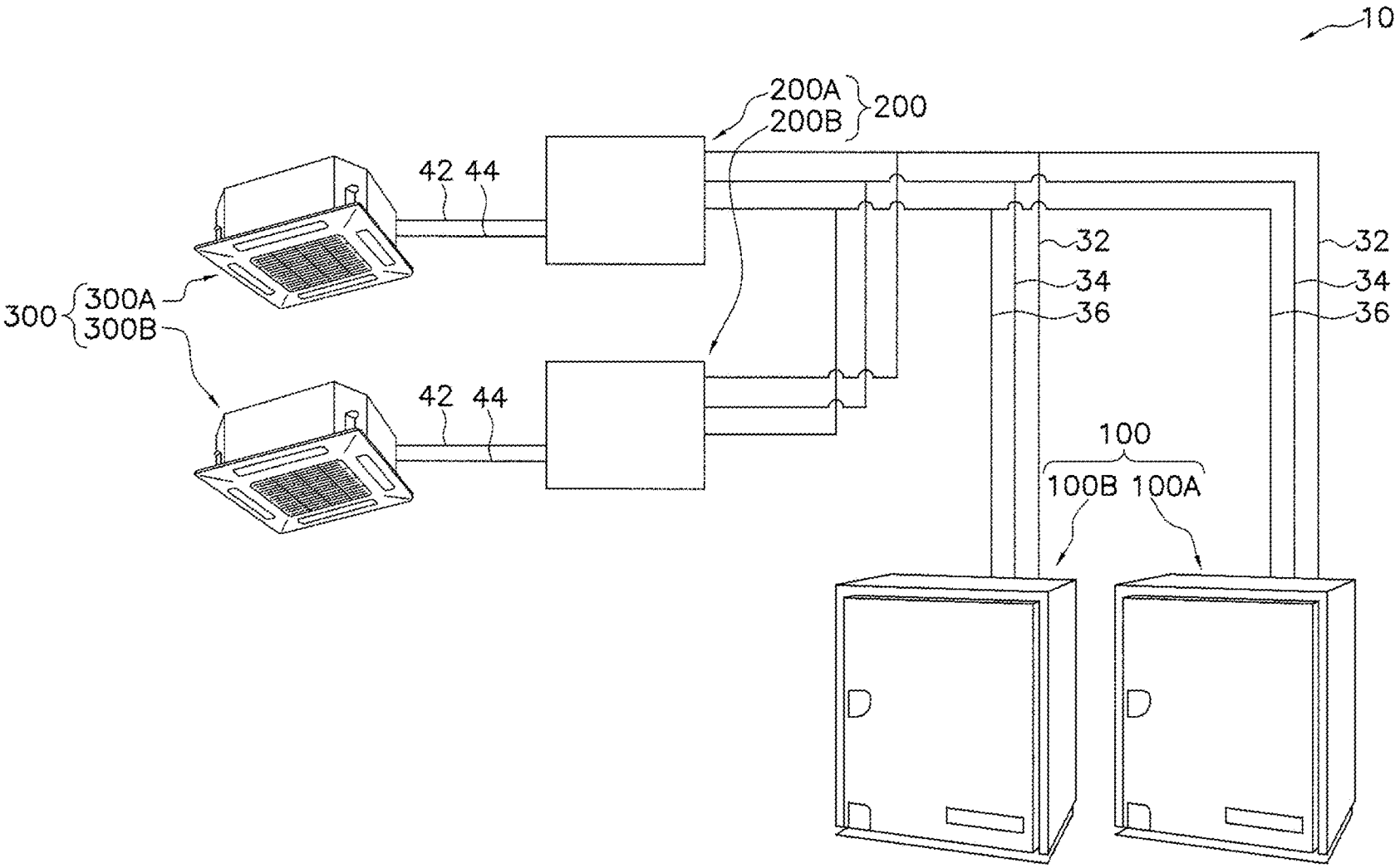
FIG. 1 is a schematic block diagram of an air conditioner as a refrigeration apparatus according to an embodiment of the present invention.
Figure 2:
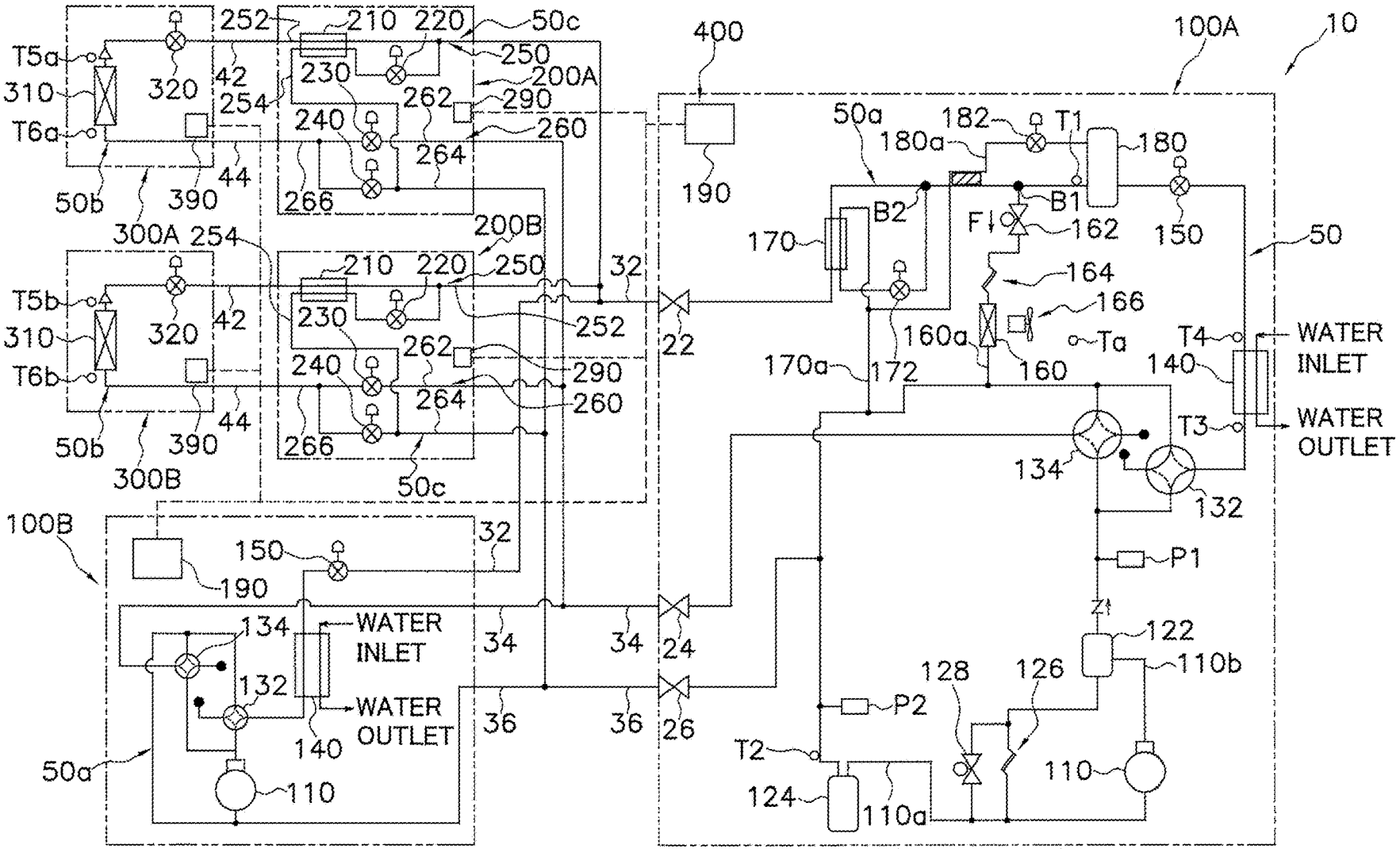
FIG. 2 is a schematic refrigerant circuit diagram of the air conditioner depicted in FIG. 1.

FIG. 1 is a schematic configuration diagram of an air conditioner 10 as the refrigeration apparatus according to the embodiment of the present invention. FIG. 2 is a schematic refrigerant circuit diagram of the air conditioner 10.

FIG. 2 depicts only part of constituents in a heat source unit 100B for simplified depiction. The actual heat source unit 100B has a configuration being similar to a heat source unit 100A.

The air conditioner 10 executes vapor-compression refrigeration cycle operation to cool or heat a target space (e.g. a room in a building). The refrigeration apparatus according to the present invention is not limited to the air conditioner but may alternatively be configured as a refrigerator, a freezer, a hot-water supply apparatus, or the like.

The air conditioner 10 mainly includes a plurality of heat source units 100 (100A and 100B), a plurality of utilization units 300 (300A and 300B), a plurality of connection units 200 (200A and 200B), refrigerant connection pipes 32, 34, and 36, and connecting pipes 42 and 44 (see FIG. 1). The connection unit 200A is configured to switch a flow of a refrigerant to the utilization unit 300A. The connection unit 200B is configured to switch a flow of the refrigerant to the utilization unit 300B. The refrigerant connection pipes 32, 34, and 36 are refrigerant pipes connecting the heat source units 100 and the connection units 200. The refrigerant connection pipes 32, 34, and 36 include a liquid-refrigerant connection pipe 32, a high and low-pressure gas-refrigerant connection pipe 34, and a low-pressure gas-refrigerant connection pipe 36. The connecting pipes 42 and 44 are refrigerant pipes connecting the connection unit 200 and the utilization unit 300. The connecting pipes 42 and 44 include a liquid connecting pipe 42 and a gas connecting pipe 44.

The numbers (two each) of the heat source units 100, the utilization units 300, and the connection units 200 depicted in FIG. 1 are merely exemplified and should not limit the present invention. For example, there may be provided one or at least three heat source units. Furthermore, there may be provided one or at least three (e.g. a large number such as ten or more) utilization units or connection units. Here, each of the utilization units is individually provided with the single connection unit. The present invention should not be limited to this configuration, but the plurality of connection units to be described below may be collected to constitute a single unit.

Each of the utilization units 300 in the present air conditioner 10 is configured to execute cooling operation or heating operation independently from the remaining utilization unit 300. In other words, in the present air conditioner 10, while part of the utilization units (e.g. the utilization unit 300A) is executing cooling operation for cooling an air conditioning target space corresponding to these utilization units, the remaining utilization unit (e.g. the utilization unit 300B) can execute heating operation for heating an air conditioning target space corresponding to those utilization units. In the present air conditioner 10, the utilization unit 300 executing heating operation sends the refrigerant to the utilization unit 300 executing cooling operation to achieve heat recovery between the utilization units 300. The air conditioner 10 is configured to balance thermal loads of the heat source units 100 in accordance with the entire thermal loads of the utilization units 300 also in consideration of the heat recovery.

(2) Detailed Configurations (2-1) Heat Source Unit

The heat source unit 100A will be described with reference to FIGS. 2 to 4. The heat source unit 100B has a configuration being similar to the heat source unit 100A. The heat source unit 100B will not be described herein to avoid repeated description.

FIG. 2 depicts only part of constituents in the heat source unit 100B for simplified depiction. The actual heat source unit 100B has a configuration being similar to the heat source unit 100A.

The heat source unit 100A is installed in a machine chamber (the interior of a room) of the building provided with the air conditioner 10, though not limited in terms of its installation site. The heat source unit 100A may alternatively be disposed outdoors.

The heat source unit 100A according to the present embodiment utilizes water as a heat source. In the heat source unit 100A, heat is exchanged between the refrigerant and water circulating in a water circuit (not depicted) to heat or cool the refrigerant. The heat source of the heat source unit 100A is not limited to water, but may alternatively be any other heating medium (e.g. a thermal-storage medium such as brine or hydrate slurry). Examples of the heat source of the heat source unit 100A may include a refrigerant. Examples of the heat source of the heat source unit 100A may include air.

The heat source unit 100A is connected to the utilization units 300 via the refrigerant connection pipes 32, 34, and 36, the connection units 200, and the connecting pipes 42 and 44. The heat source unit 100A and the utilization units 300 constitute a refrigerant circuit 50 (see FIG. 2). The refrigerant circulates in the refrigerant circuit 50 while the air conditioner 10 is in operation.

The refrigerant adopted in the present embodiment is a substance that absorbs peripheral heat in a liquid state to come into a gaseous state and radiates heat to the periphery in the gaseous state to come into the liquid state in the refrigerant circuit 50. Examples of the refrigerant include a fluorocarbon refrigerant, though not limited in terms of its type.

As depicted in FIG. 2, the heat source unit 100A mainly includes a heat source-side refrigerant circuit 50*a* constituting part of the refrigerant circuit 50. The heat source-side refrigerant circuit 50*a* includes a compressor 110, a heat source-side heat exchanger 140 exemplifying a main heat exchanger, and a heat source-side flow-rate control valve 150. The heat source-side refrigerant circuit 50*a* also includes a first flow path switching mechanism 132 and a second flow path switching mechanism 134. The heat source-side refrigerant circuit 50*a* further includes an oil separator 122 and an accumulator 124. The heat source-side refrigerant circuit 50*a* further includes a receiver 180 and a gas vent pipe flow-rate control valve 182. The heat source-side refrigerant circuit 50*a* further includes a subcooling heat exchanger 170 and a second suction return valve 172. The heat source-side refrigerant circuit 50*a* further includes a cooling heat exchanger 160, a first suction return valve 162, and a capillary 164. The heat source-side refrigerant circuit 50*a* further includes a bypass valve 128. The heat source-side refrigerant circuit 50*a* further includes a liquid-side shutoff valve 22, a high and low-pressure gas-side shutoff valve 24, and a low-pressure gas-side shutoff valve 26.

Figure 3:
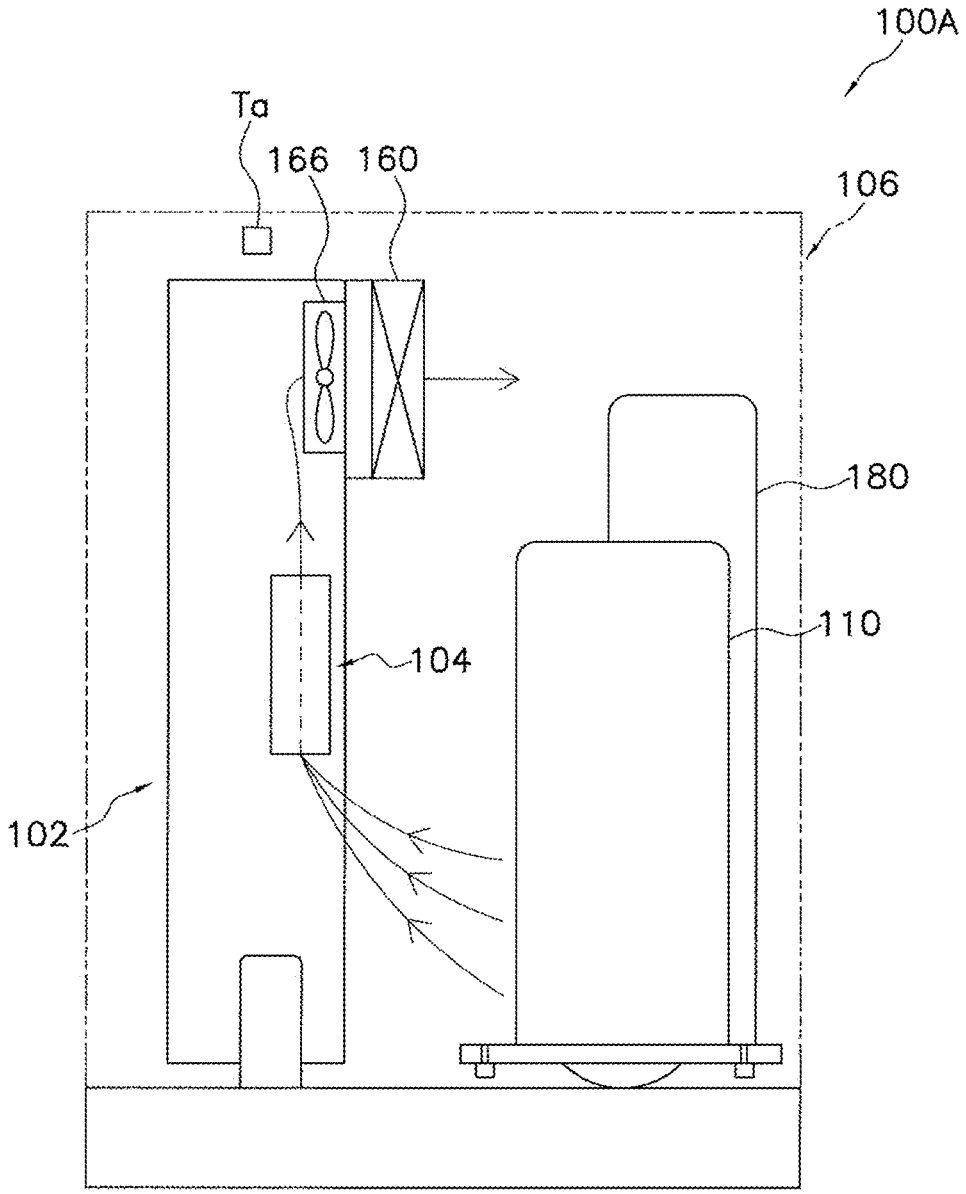
FIG. 3 is a schematic side view of the interior of a heat source unit included in the air conditioner depicted in FIG. 1.
Figure 4:
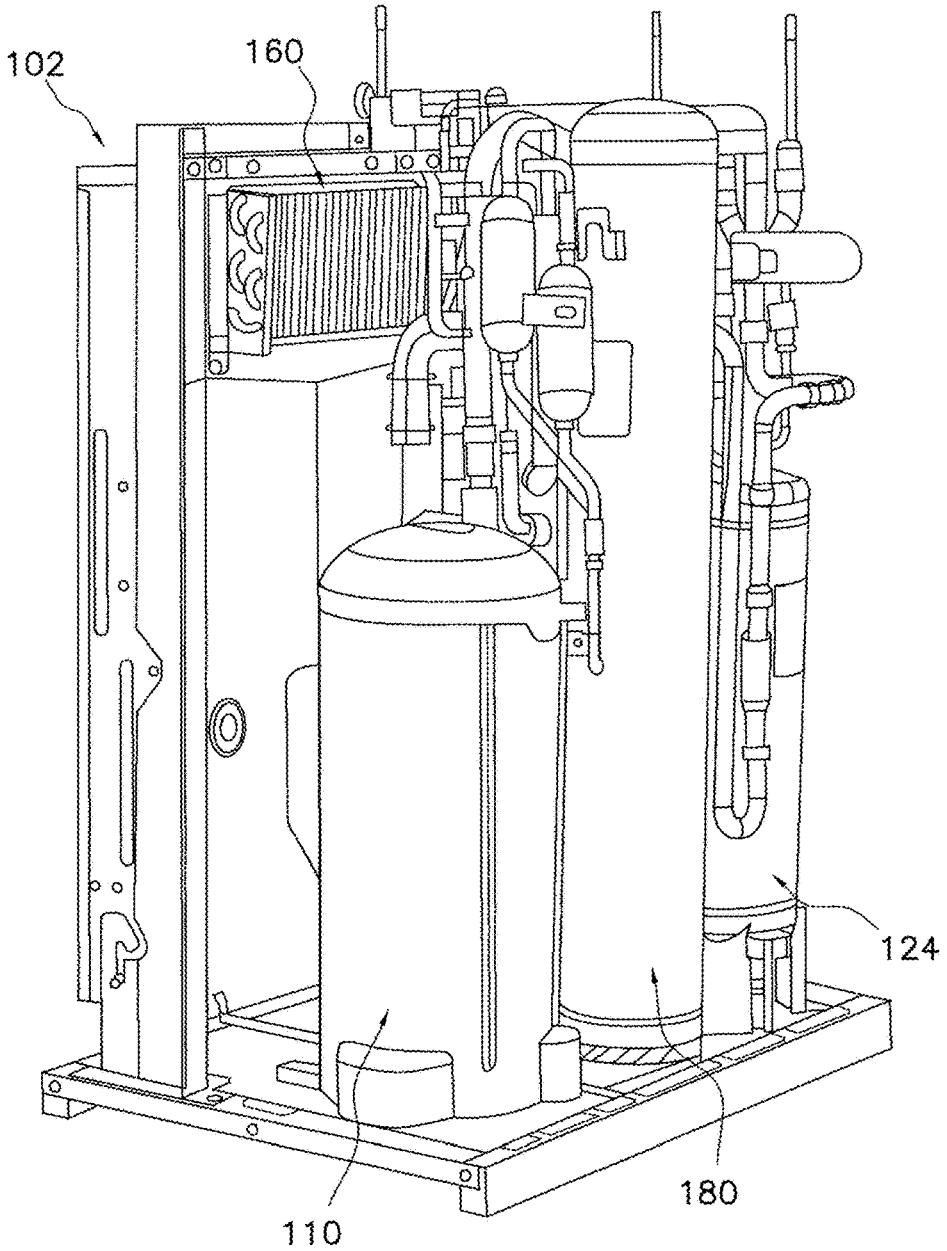
FIG. 4 is a schematic perspective view of the interior of the heat source unit in the air conditioner depicted in FIG. 1.

The heat source unit 100A includes a casing 106, an electric component box 102, a fan 166, pressure sensors P1 and P2, temperature sensors T1, T2, T3, T4, and Ta, and a heat source unit controller 190 (see FIG. 2 and FIG. 3). The casing 106 is a housing accommodating various constituent equipment of the heat source unit 100A, such as the compressor 110 and the heat source-side heat exchanger 140.

Such various constituents of the heat source-side refrigerant circuit 50*a*, the electric component box 102, the fan 166, the pressure sensors P1 and P2, the temperature sensors T1, T2, T3, T4, and Ta, and the heat source unit controller 190 will be described in more detail below.

(2-1-1) Heat Source-Side Refrigerant Circuit (2-1-1-1) Compressor

The compressor 110 is of a positive-displacement type such as a scroll type or a rotary type, though not limited in terms of its type. The compressor 110 has a hermetic structure incorporating a compressor motor (not depicted). The compressor 110 is configured to vary operating capacity through inverter control of the compressor motor.

The compressor 110 has a suction port (not depicted) connected to a suction pipe 110*a* (see FIG. 2). The compressor 110 compresses a low-pressure refrigerant sucked via the suction port, and then discharges the compressed refrigerant from a discharge port (not depicted). The discharge port of the compressor 110 is connected to a discharge pipe 110*b* (see FIG. 2).

(2-1-1-2) Oil Separator

The oil separator 122 separates lubricant from gas discharged from the compressor 110. The oil separator 122 is provided at the discharge pipe 110*b*. The lubricant separated by the oil separator 122 returns to a suction side (the suction pipe 110*a*) of the compressor 110 via the capillary 126 (see FIG. 2).

(2-1-1-3) Accumulator

The accumulator 124 is provided at the suction pipe 110*a* (see FIG. 2). The accumulator 124 is a reservoir temporarily storing a low-pressure refrigerant to be sucked into the compressor 110 and performing gas-liquid separation. In the accumulator 124, a refrigerant in a gas-liquid two-phase state is separated into a gas refrigerant and a liquid refrigerant, and the compressor 110 receives mainly the gas refrigerant.

(2-1-1-4) First Flow Path Switching Mechanism

The first flow path switching mechanism 132 is configured to switch a flow direction of a refrigerant flowing in the heat source-side refrigerant circuit 50*a*. The first flow path switching mechanism 132 is exemplarily constituted by a four-way switching valve as depicted in FIG. 2. The four-way switching valve adopted as the first flow path switching mechanism 132 is configured to block a flow of a refrigerant in one refrigerant flow path to substantially function as a three-way valve.

In a case where the heat source-side heat exchanger 140 functions as a radiator (condenser) for a refrigerant flowing in the heat source-side refrigerant circuit 50*a* (hereinafter, also called a "radiating operation state"), the first flow path switching mechanism 132 connects a discharge side (the discharge pipe 110*b*) of the compressor 110 and a gas side of the heat source-side heat exchanger 140 (see a solid line in the first flow path switching mechanism 132 in FIG. 2). In another case where the heat source-side heat exchanger 140 functions as a heat absorber (evaporator) for a refrigerant flowing in the heat source-side refrigerant circuit 50*a* (hereinafter, also called a "heat absorbing operation state"), the first flow path switching mechanism 132 connects the suction pipe 110*a* and the gas side of the heat source-side heat exchanger 140 (see a broken line in the first flow path switching mechanism 132 in FIG. 2).

(2-1-1-5) Second Flow Path Switching Mechanism

The second flow path switching mechanism 134 is configured to switch a flow direction of a refrigerant flowing in the heat source-side refrigerant circuit 50*a*. The second flow path switching mechanism 134 is exemplarily constituted by a four-way switching valve as depicted in FIG. 2. The four-way switching valve adopted as the second flow path switching mechanism 134 is configured to block a flow of a refrigerant in one refrigerant flow path to substantially function as a three-way valve.

In a case where a high-pressure gas refrigerant discharged from the compressor 110 is sent to the high and low-pressure gas-refrigerant connection pipe 34 (hereinafter, also called a "radiation load operation state"), the second flow path switching mechanism 134 connects the discharge side (the discharge pipe 110*b*) of the compressor 110 and the high and low-pressure gas-side shutoff valve 24 (see a broken line in the second flow path switching mechanism 134 in FIG. 2). In another case where the high-pressure gas refrigerant discharged from the compressor 110 is not sent to the high and low-pressure gas-refrigerant connection pipe 34 (hereinafter, also called an "evaporation load operation state"), the second flow path switching mechanism 134 connects the high and low-pressure gas-side shutoff valve 24 and the suction pipe 110*a* of the compressor 110 (see a solid line in the second flow path switching mechanism 134 in FIG. 2).

(2-1-1-6) Heat Source-Side Heat Exchanger

The heat source-side heat exchanger 140 exemplifying the main heat exchanger causes heat exchange between the refrigerant and the heat source (cooling water or warm water circulating in the water circuit in the present embodiment). Such liquid fluid is not controlled at the air conditioner 10 in terms of its temperature and its flow rate, although the present invention is not limited to such a configuration. The heat source-side heat exchanger 140 is exemplarily configured as a plate heat exchanger. The heat source-side heat exchanger 140 has the gas side for the refrigerant connected to the first flow path switching mechanism 132 via a pipe, and also has the liquid side for the refrigerant connected to the heat source-side flow-rate control valve 150 via a pipe (see FIG. 2).

(2-1-1-7) Heat Source-Side Flow-Rate Control Valve

The heat source-side flow-rate control valve 150 is configured to control a flow rate of a refrigerant flowing in the heat source-side heat exchanger 140. The heat source-side flow-rate control valve 150 is provided at the liquid side (on a pipe connecting the heat source-side heat exchanger 140 and the liquid-side shutoff valve 22) of the heat source-side heat exchanger 140 (see FIG. 2). In other words, the heat source-side flow-rate control valve 150 is provided on a pipe connecting the heat source-side heat exchanger 140 and utilization heat exchangers 310 in the utilization units 300. The heat source-side flow-rate control valve 150 is exemplarily configured as an electric expansion valve having a controllable opening degree.

(2-1-1-8) Receiver and Gas Vent Pipe Flow-Rate Control Valve

The receiver 180 is a reservoir temporarily storing a refrigerant flowing between the heat source-side heat exchanger 140 and the utilization units 300. The receiver 180 is disposed between the heat source-side flow-rate control valve 150 and the liquid-side shutoff valve 22, on a pipe connecting the liquid side of the heat source-side heat exchanger 140 and the utilization units 300 (see FIG. 2). The receiver 180 has a top portion connected to a receiver gas vent pipe 180*a* (see FIG. 2). The receiver gas vent pipe 180*a* connects the top portion of the receiver 180 and the suction side of the compressor 110.

The receiver gas vent pipe 180*a* is provided with the gas vent pipe flow-rate control valve 182 configured to control a flow rate of a refrigerant to be subjected to gas venting from the receiver 180. The gas vent pipe flow-rate control valve 182 is exemplarily configured as an electric expansion valve having a controllable opening degree.

(2-1-1-9) Cooling Heat Exchanger and First Suction Return Valve

The heat source-side refrigerant circuit 50*a* is provided with a first suction return pipe 160*a* branching at a branching point B1 from a pipe connecting the receiver 180 and the liquid-side shutoff valve 22 and connected to the suction side (the suction pipe 110*a*) of the compressor 110 (see FIG. 2). The first suction return pipe 160*a* connects the pipe connecting between the heat source-side heat exchanger 140 and the utilization heat exchangers 310 in the utilization units 300 and the suction pipe 110*a* of the compressor 110.

The first suction return pipe 160*a* is provided with the cooling heat exchanger 160, the first suction return valve 162, and the capillary 164 (see FIG. 2). The first suction return valve 162 exemplifies a valve. The cooling heat exchanger 160 is supplied with a refrigerant to cool the interior of the casing 106 of the heat source unit 100A. The first suction return valve 162 switches to supply or not to supply the cooling heat exchanger 160 with a refrigerant. The capillary 164 is disposed downstream of the first suction return valve 162 in a refrigerant flow direction F (see FIG. 2) of the refrigerant flowing to the cooling heat exchanger 160 when the first suction return valve 162 is opened. The refrigerant flow direction F is a direction from the branching point B1 toward the suction side (the suction pipe 110*a*) of the compressor 110. The capillary 164 may alternatively be disposed upstream of the first suction return valve 162 in the refrigerant flow direction F.

The first suction return pipe 160*a* may be provided with an electric expansion valve having a controllable opening degree, in place of the first suction return valve 162 and the capillary 164.

The cooling heat exchanger 160 is configured to cause heat exchange between a refrigerant flowing in the cooling heat exchanger 160 and air. The cooling heat exchanger 160 is exemplarily of a cross-fin type, though not limited in terms of its type. The cooling heat exchanger 160 is supplied with air by the fan 166 to be described later for stimulated heat exchange between the refrigerant and the air.

(2-1-1-10) Subcooling Heat Exchanger and Suction Return Flow-Rate Control Valve

The heat source-side refrigerant circuit 50*a* is provided with a second suction return pipe 170*a* branching at a branching point B2 from the pipe connecting the receiver 180 and the liquid-side shutoff valve 22 and connected to the suction side (the suction pipe 110*a*) of the compressor 110 (see FIG. 2). The second suction return pipe 170*a* is provided with the second suction return valve 172 (see FIG. 2). The second suction return valve 172 is exemplarily configured as an electric expansion valve having a controllable opening degree.

The subcooling heat exchanger 170 is provided on the pipe connecting the receiver 180 and the liquid-side shutoff valve 22, at a position shifted from the branching point B2 toward the liquid-side shutoff valve 22. The subcooling heat exchanger 170 causes heat exchange between the refrigerant flowing through the pipe connecting the receiver 180 and the liquid-side shutoff valve 22 and the refrigerant flowing through the second suction return pipe 170*a* to cool the refrigerant flowing through the pipe connecting the receiver 180 and the liquid-side shutoff valve 22. The subcooling heat exchanger 170 is exemplarily configured as a double pipe heat exchanger.

(2-1-1-11) Bypass Valve

The bypass valve 128 is provided on a pipe connecting the oil separator 122 and the suction pipe 110*a* of the compressor 110 (see FIG. 2). The bypass valve 128 is configured as an electromagnetic valve controlled to open and close. When the bypass valve 128 is controlled to open, the refrigerant discharged from the compressor 110 partially flows into the suction pipe 110*a*.

The bypass valve 128 is appropriately controlled to open or close in accordance with an operation situation of the air conditioner 10. In a case where the compressor motor is inverter controlled to reduce the operating capacity of the compressor 110 and the operating capacity thus reduced is still excessive, the bypass valve 128 may be opened to reduce quantity of the refrigerant circulating in the refrigerant circuit 50. The bypass valve 128 may be opened at predetermined timing to increase a heating degree at the suction side of the compressor 110 for prevention of liquid compression.

(2-1-1-12) Liquid-Side Shutoff Valve, High and Low-Pressure Gas-Side Shutoff Valve, and Low-Pressure Gas-Side Shutoff Valve The liquid-side shutoff valve 22, the high and low-pressure gas-side shutoff valve 24, and the low-pressure gas-side shutoff valve 26 are manually operated to open or close upon refrigerant filling, pump down, and the like.

The liquid-side shutoff valve 22 has a first end connected to the liquid-refrigerant connection pipe 32 and a second end connected to a refrigerant pipe extending toward the heat source-side flow-rate control valve 150 via the receiver 180 (see FIG. 2).

The high and low-pressure gas-side shutoff valve 24 has a first end connected to the high and low-pressure gas-refrigerant connection pipe 34 and a second end connected to a refrigerant pipe extending to the second flow path switching mechanism 134 (see FIG. 2).

The low-pressure gas-side shutoff valve 26 has a first end connected to the low-pressure gas-refrigerant connection pipe 36 and a second end connected to a refrigerant pipe extending to the suction pipe 110*a* (see FIG. 2).

(2-1-2) Electric Component Box and Fan

The casing 106 of the heat source unit 100A accommodates the electric component box 102. The electric component box 102 has a rectangular parallelepiped shape, though not limited in terms of its shape. The electric component box 102 accommodates electric components 104 configured to control operation of the various constituents, such as the compressor 110, the flow path switching mechanisms 132 and 134, and the valves 150, 182, 172, 162, and 128, in the heat source unit 100A in the air conditioner 10 (see FIG. 3). The electric components 104 include electric components constituting an inverter circuit for control of the motor of the compressor 110, as well as electric components such as a microcomputer and a memory constituting the heat source unit controller 190 to be described later.

The electric component box 102 has a lower opening (not depicted) allowing air to enter the electric component box 102, and an upper opening (not depicted) allowing air to blow out of the electric component box 102. The fan 166 is provided adjacent to the upper opening (see FIG. 3). The fan 166 is provided, on an air blow-out side (downstream in an air blow-out direction), with the cooling heat exchanger 160 (see FIG. 3 and FIG. 4). When the fan 166 operates, air flowed into the electric component box 102 through the lower opening moves upward in the electric component box 102 and blows out of the electric component box 102 through the upper opening. When the air moves in the electric component box 102, the air moving in the electric component box 102 cools the electric components 104. Air absorbed heat from the electric components 104 and thus warmed blows out of the electric component box 102 into the casing 106 through the upper opening. The present air conditioner 10 includes the fan 166 configured as a constant-speed fan. The fan 166 may alternatively be a variable speed fan.

The casing 106 has a suction opening (not depicted) disposed in a lower portion of a side surface, and an exhaust opening (not depicted) disposed in a top portion, to allow ventilation in the casing 106 with air from outside the casing 106. The interior of the casing 106 is increased in temperature in a case where the ventilation is insufficient relatively to heat generated by the electric components 104, the motor of the compressor 110, and the like, or in a case where the casing 106 has relatively high ambient temperature.

(2-1-3) Pressure Sensor

The heat source unit 100A includes the plurality of pressure sensors configured to measure pressure of a refrigerant. The pressure sensors include the high pressure sensor P1 and the low pressure sensor P2.

The high pressure sensor P1 is disposed on the discharge pipe 110*b* (see FIG. 2). The high pressure sensor P1 measures pressure of a refrigerant discharged from the compressor 110. In other words, the high pressure sensor P1 measures high pressure in the refrigeration cycle.

The low pressure sensor P2 is disposed on the suction pipe 110*a* (see FIG. 2). The low pressure sensor P2 measures pressure of a refrigerant sucked into the compressor 110. In other words, the low pressure sensor P2 measures low pressure in the refrigeration cycle.

(2-1-4) Temperature Sensor

The heat source unit 100A includes the plurality of temperature sensors configured to measure temperature of a refrigerant.

The temperature sensors configured to measure temperature of a refrigerant may include the liquid-refrigerant temperature sensor T1 provided on the pipe connecting the receiver 180 and the liquid-side shutoff valve 22, at a position shifted from the branching point B1, where the first suction return pipe 160*a* branches, toward the receiver 180 (see FIG. 2). The temperature sensors configured to measure temperature of a refrigerant may also include the sucked refrigerant temperature sensor T2 provided upstream of the accumulator 124, on the suction pipe 110*a* (see FIG. 2). The temperature sensors configured to measure temperature of a refrigerant also include the gas-side temperature sensor T3 provided on the gas side of the heat source-side heat exchanger 140, and the liquid-side temperature sensor T4 provided on the liquid side of the heat source-side heat exchanger 140 (see FIG. 2). The temperature sensors configured to measure temperature of a refrigerant may also include a discharge temperature sensor (not depicted) provided on the discharge pipe 110*b* of the compressor 110. The temperature sensors configured to measure temperature of a refrigerant may also include temperature sensors (not depicted) provided upstream and downstream of the subcooling heat exchanger 170 in a refrigerant flow direction of the second suction return pipe 170*a*. The temperature sensors configured to measure temperature of a refrigerant may also include a temperature sensor provided downstream of the cooling heat exchanger 160 in a refrigerant flow direction of the first suction return pipe 160*a*.

The heat source unit 100A includes the casing internal temperature sensor Ta configured to measure temperature in the casing 106. The casing internal temperature sensor Ta is installed adjacent to a ceiling of the casing 106, though not limited in terms of its installation site (see FIG. 3).

(2-1-5) Heat Source Unit Controller

The heat source unit controller 190 includes the microcomputer and the memory provided for control of the heat source unit 100A. The heat source unit controller 190 is electrically connected to the various sensors including the pressure sensors P1 and P2 and the temperature sensors T1, T2, T3, T4, and Ta. FIG. 2 omits depicting connections between the heat source unit controller 190 and the sensors. The heat source unit controller 190 is also electrically connected to connection unit controllers 290 in the connection units 200A and 200B, and utilization unit controllers 390 in the utilization units 300A and 300B, for transmission and reception of control signals to and from the connection unit controllers 290 and the utilization unit controllers 390. The heat source unit controllers 190, the connection unit controllers 290, and the utilization unit controllers 390 operate in cooperation as a control unit 400 configured to control the air conditioner 10. Control of the air conditioner 10 by the control unit 400 will be described later.

(2-2) Utilization Unit

The utilization unit 300A will be described with reference to FIG. 2. The utilization unit 300B is configured similarly to the utilization unit 300A and thus will not be described herein to avoid repeated description.

The utilization unit 300A may be of a ceiling embedded type and be embedded in a ceiling of the room in the building as exemplarily depicted in FIG. 1. The utilization unit 300A should not be limited to the ceiling embedded type, but may alternatively be of a ceiling pendant type, a wall mounted type to be mounted on a wall surface in the room, or the like. The utilization unit 300A and the utilization unit 300B may not be of a same type.

The utilization unit 300A is connected to the heat source units 100 via the connecting pipes 42 and 44, the connection unit 200A, and the refrigerant connection pipes 32, 34, and 36. The utilization unit 300A and the heat source unit 100 constitute the refrigerant circuit 50.

The utilization unit 300A includes a utilization refrigerant circuit 50*b* constituting part of the refrigerant circuit 50. The utilization refrigerant circuit 50*b* mainly includes a utilization flow-rate control valve 320 and the utilization heat exchanger 310. The utilization unit 300A further includes temperature sensors T5*a* and T6*a*, and the utilization unit controller 390. The utilization unit 300B includes temperature sensors denoted by reference signs T5*b* and T6*b* in FIG. 2 for convenience of description, but the temperature sensors T5*b* and T6*b* are configured similarly to the temperature sensors T5*a* and T6*a* included in the utilization unit 300A.

(2-2-1) Utilization Refrigerant Circuit (2-2-1-1) Utilization Flow-Rate Control Valve The utilization flow-rate control valve 320 is configured to control a flow rate of a refrigerant flowing in the utilization heat exchanger 310. The utilization flow-rate control valve 320 is provided on a liquid side of the utilization heat exchanger 310 (see FIG. 2). The utilization flow-rate control valve 320 is exemplarily configured as an electric expansion valve having a controllable opening degree.

(2-2-1-2) Utilization Heat Exchanger

The utilization heat exchanger 310 causes heat exchange between a refrigerant and indoor air. Examples of the utilization heat exchanger 310 include a fin-and-tube heat exchanger constituted by a plurality of heat transfer tubes and a fin. The utilization unit 300A includes an indoor fan (not depicted) configured to suck indoor air into the utilization unit 300A, supply the utilization heat exchanger 310 with the indoor air, and supply air after heat exchange in the utilization heat exchanger 310 into the room. The indoor fan is driven by an indoor fan motor (not depicted).

(2-2-2) Temperature Sensor

The utilization unit 300A includes the plurality of temperature sensors configured to measure temperature of a refrigerant. The temperature sensors configured to measure temperature of a refrigerant include the liquid-side temperature sensor T5*a* configured to measure temperature of the refrigerant on the liquid side (at an outlet of the utilization heat exchanger 310 functioning as a radiator for a refrigerant) of the utilization heat exchanger 310. The temperature sensors configured to measure temperature of a refrigerant also include the gas-side temperature sensor T6*a* configured to measure temperature of the refrigerant on a gas side (at an inlet of the utilization heat exchanger 310 functioning as a radiator for a refrigerant) of the utilization heat exchanger 310.

The utilization unit 300A includes a temperature sensor (not depicted) configured to measure temperature in the room as the air conditioning target space.

(2-2-3) Utilization Unit Controller

The utilization unit controller 390 in the utilization unit 300A includes a microcomputer and a memory provided for control of the utilization unit 300A. The utilization unit controller 390 in the utilization unit 300A is electrically connected to various sensors including the temperature sensors T5*a* and T6*a* (FIG. 2 does not depict connection between the utilization unit controller 390 and the sensors). The utilization unit controller 390 in the utilization unit 300A is also electrically connected to the heat source unit controller 190 in the heat source unit 100A and the connection unit controller 290 in the connection unit 200A, for transmission and reception of control signals to and from the heat source unit controller 190 and the connection unit controller 290. The heat source unit controllers 190, the connection unit controllers 290, and the utilization unit controllers 390 operate in cooperation as the control unit 400 configured to control the air conditioner 10. Control of the air conditioner 10 by the control unit 400 will be described later.

(2-3) Connection Unit

The connection unit 200A will be described with reference to FIG. 2. The connection unit 200B is configured similarly to the connection unit 200A, and thus will not be described herein to avoid repeated description.

The connection unit 200A and the utilization unit 300A are installed together. The connection unit 200A may be installed in a ceiling cavity of the room and adjacent to the utilization unit 300A.

The connection unit 200A is connected to the heat source units 100 (100A and 100B) via the refrigerant connection pipes 32, 34, and 36. The connection unit 200A is also connected to the utilization unit 300A via the connecting pipes 42 and 44. The connection unit 200A constitutes part of the refrigerant circuit 50. The connection unit 200A is disposed between the heat source unit 100 and the utilization unit 300A, and switches a flow of a refrigerant flowing into the heat source unit 100 and the utilization unit 300A.

The connection unit 200A includes a connection refrigerant circuit 50*c* constituting part of the refrigerant circuit 50. The connection refrigerant circuit 50*c* mainly includes a liquid refrigerant pipe 250 and a gas refrigerant pipe 260. The connection unit 200A further includes the connection unit controller 290.

(2-3-1) Connection Refrigerant Circuit (2-3-1-1) Liquid Refrigerant Pipe

The liquid refrigerant pipe 250 includes a main liquid refrigerant pipe 252 and a branching liquid refrigerant pipe 254.

The main liquid refrigerant pipe 252 connects the liquid-refrigerant connection pipe 32 and the liquid connecting pipe 42. The branching liquid refrigerant pipe 254 connects the main liquid refrigerant pipe 252 and a low-pressure gas refrigerant pipe 264 of the gas refrigerant pipe 260 to be described later. The branching liquid refrigerant pipe 254 is provided with a branching pipe control valve 220. The branching pipe control valve 220 is exemplarily configured as an electric expansion valve having a controllable opening degree. The main liquid refrigerant pipe 252 is provided with a subcooling heat exchanger 210 disposed at a position shifted from a branching point of the branching liquid refrigerant pipe 254 toward the liquid connecting pipe 42. If the branching pipe control valve 220 is opened when the refrigerant flows from the liquid side to the gas side in the utilization heat exchanger 310 of the utilization unit 300A, the subcooling heat exchanger 210 causes heat exchange between the refrigerant flowing through the main liquid refrigerant pipe 252 and the refrigerant flowing through the branching liquid refrigerant pipe 254 from the main liquid refrigerant pipe 252 to the low-pressure gas refrigerant pipe 264 to cool the refrigerant flowing through the main liquid refrigerant pipe 252. The subcooling heat exchanger 210 is exemplarily configured as a double pipe heat exchanger.

(2-3-1-2) Gas Refrigerant Pipe

The gas refrigerant pipe 260 includes a high and low-pressure gas refrigerant pipe 262, the low-pressure gas refrigerant pipe 264, and a joined gas refrigerant pipe 266. The high and low-pressure gas refrigerant pipe 262 has a first end connected to the high and low-pressure gas-refrigerant connection pipe 34 and a second end connected to the joined gas refrigerant pipe 266. The low-pressure gas refrigerant pipe 264 has a first end connected to the low-pressure gas-refrigerant connection pipe 36 and a second end connected to the joined gas refrigerant pipe 266. The joined gas refrigerant pipe 266 has a first end connected to the high and low-pressure gas refrigerant pipe 262 and the low-pressure gas refrigerant pipe 264, and a second end connected to the gas connecting pipe 44. The high and low-pressure gas refrigerant pipe 262 is provided with a high and low-pressure valve 230. The low-pressure gas refrigerant pipe 264 is provided with a low pressure valve 240. Each of the high and low-pressure valve 230 and the low pressure valve 240 may be configured as a motor valve.

(2-3-2) Connection Unit Controller

The connection unit controller 290 includes a microcomputer and a memory provided for control of the connection unit 200A. The connection unit controller 290 is electrically connected to the heat source unit controller 190 in the heat source unit 100A and the utilization unit controller 390 in the utilization unit 300A, for transmission and reception of control signals to and from the heat source unit controller 190 and the utilization unit controller 390. The heat source unit controllers 190, the connection unit controllers 290, and the utilization unit controllers 390 operate in cooperation as the control unit 400 configured to control the air conditioner 10. Control of the air conditioner 10 by the control unit 400 will be described later.

(2-3-3) Refrigerant Flow Rate Switching by Connection Unit

When the utilization unit 300A executes cooling operation, the connection unit 200A brings the low pressure valve 240 into an opened state, and sends the refrigerant flowing from the liquid-refrigerant connection pipe 32 into the main liquid refrigerant pipe 252 to the utilization heat exchanger 310 via the liquid connecting pipe 42 and the utilization flow-rate control valve 320 of the utilization refrigerant circuit 50*b* in the utilization unit 300A. The connection unit 200A sends, to the low-pressure gas-refrigerant connection pipe 36 via the joined gas refrigerant pipe 266 and the low-pressure gas refrigerant pipe 264, the refrigerant evaporated through heat exchange with indoor air in the utilization heat exchanger 310 of the utilization unit 300A and flowed into the gas connecting pipe 44.

When the utilization unit 300A executes heating operation, the connection unit 200A brings the low pressure valve 240 into a closed state and brings the high and low-pressure valve 230 into the opened state, and sends the refrigerant flowing through the high and low-pressure gas-refrigerant connection pipe 34 into the high and low-pressure gas refrigerant pipe 262, to the utilization heat exchanger 310 in the utilization refrigerant circuit 50*b* of the utilization unit 300A via the joined gas refrigerant pipe 266 and gas connecting pipe 44. The connection unit 200A sends, to the liquid-refrigerant connection pipe 32 via the main liquid refrigerant pipe 252, the refrigerant which radiated heat through heat exchange with indoor air in the utilization heat exchanger 310 and flowed into the liquid connecting pipe 42 via the utilization flow-rate control valve 320.

(2-4) Control Unit

The control unit 400 is a functional unit configured to control the air conditioner 10. To function as the control unit 400, the heat source unit controllers 190 in the heat source units 100, the connection unit controllers 290 in the connection units 200, and the utilization unit controllers 390 in the utilization units 300 operate in cooperation. The present embodiment is not limited to this configuration, but the control unit 400 may alternatively be configured as a control device independent from the heat source units 100, the connection units 200, and the utilization units 300.

The control unit 400 causes a microcomputer included in the control unit 400 to execute a program stored in a memory included in the control unit 400 to control operation of the air conditioner 10. Herein, the memories of the heat source unit controllers 190, the connection unit controllers 290, and the utilization unit controllers 390 are collectively called the memory of the control unit 400, whereas the microcomputers of the heat source unit controllers 190, the connection unit controllers 290, and the utilization unit controllers 390 are collectively called the microcomputer of the control unit 400.

The control unit 400 controls operation of various constituent equipment of the heat source units 100, the connection units 200, and the utilization units 300 in accordance with measurement values of various sensors included in the air conditioner 10 as well as a command and setting inputted by a user to an operation unit (not depicted; e.g. a remote controller) to achieve appropriate operation. The control unit 400 has operation control target equipment including the compressor 110, the heat source-side flow-rate control valve 150, the first flow path switching mechanism 132, the second flow path switching mechanism 134, the gas vent pipe flow-rate control valve 182, the first suction return valve 162, the second suction return valve 172, the bypass valve 128, and the fan 166 in each of the heat source units 100. The operation control target equipment of the control unit 400 further include the utilization flow-rate control valve 320 and the indoor fan in each of the utilization units 300. The operation control target equipment of the control unit 400 also include the branching pipe control valve 220, the high and low-pressure valve 230, and the low pressure valve 240 in each of the connection units 200.

Brief description will be made later to control of various constituent equipment in the air conditioner 10 by the control unit 400 during cooling operation (when the utilization units 300A and 300B both execute cooling operation), during heating operation (when the utilization units 300A and 300B both execute heating operation), and during simultaneous cooling and heating operation (when the utilization unit 300A executes cooling operation and the utilization unit 300B executes heating operation) of the air conditioner 10.

Described further below is control to open or close the first suction return valve 162 (configured to switch to supply or not to supply the cooling heat exchanger 160 with a refrigerant) by the control unit 400.

Figure 5:
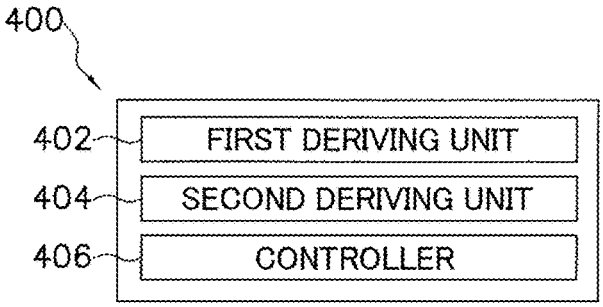
FIG. 5 is a block diagram of a control unit included in the air conditioner depicted in FIG. 1, that particularly shows functional units relevant to control of a first suction return valve included in the heat source unit.

The microcomputer of the control unit 400 includes, as functional units relevant to control of the first suction return valve 162, a first deriving unit 402, a second deriving unit 404, and a controller 406 as depicted in FIG. 5.

(2-4-1) First Deriving Unit

The first deriving unit 402 derives first pressure Pr1 upstream of the first suction return valve 162 in the refrigerant flow direction F (see FIG. 2) of the refrigerant flowing to the cooling heat exchanger 160 when the first suction return valve 162 is opened. The refrigerant flow direction F is a direction along the first suction return pipe 160*a* from the branching point B1 on the pipe connecting the receiver 180 and the liquid-side shutoff valve 22 toward the suction side (the suction pipe 110*a*) of the compressor 110. The first deriving unit 402 derives pressure of the refrigerant around the branching point B1 on the pipe connecting the receiver 180 and the liquid-side shutoff valve 22.

Specifically, the first deriving unit 402 calculates the first pressure Pr1 in accordance with information on a relation between temperature and pressure of a refrigerant (e.g. a correspondence table on saturation temperature and pressure of a refrigerant) stored in the memory of the control unit 400 and temperature measured by the liquid-refrigerant temperature sensor T1 disposed adjacent to the branching point B1 on the refrigerant pipe.

In this embodiment, the first deriving unit 402 calculates the first pressure Pr1 in accordance with the temperature measured by the liquid-refrigerant temperature sensor T1. However, a method of deriving the first pressure Pr1 is not limited thereto. In a case where the first flow path switching mechanism 132 connects the discharge pipe 110*b* and the gas side of the heat source-side heat exchanger 140 to cause the heat source-side heat exchanger 140 to function as a radiator, the first deriving unit 402 may calculate the first pressure Pr1 by subtracting, from pressure measured by the pressure sensor P1, a pressure loss between the pressure sensor P1 and the branching point B1 obtained from a current opening degree of the heat source-side flow-rate control valve 150 or the like. There may be provided a pressure sensor adjacent to the branching point B1 on the refrigerant pipe and the first deriving unit 402 may calculate the first pressure Pr1 directly from a measurement value of the pressure sensor.

(2-4-2) Second Deriving Unit

The second deriving unit 404 derives second pressure Pr2 downstream of the cooling heat exchanger 160 in the refrigerant flow direction F (see FIG. 2) of the refrigerant flowing to the cooling heat exchanger 160 when the first suction return valve 162 is opened. In other words, the second deriving unit 404 derives pressure of the refrigerant in the suction pipe 110*a*.

Specifically, the second deriving unit 404 derives, as the second pressure Pr2, suction pressure of the compressor 110 measured by the pressure sensor P2. This is an exemplary method of deriving the second pressure Pr2 by the second deriving unit 404, and the second pressure Pr2 may alternatively be derived in accordance with temperature of the refrigerant or the like.

(2-4-3) Controller

The controller 406 controls to open or close the first suction return valve 162.

The controller 406 basically controls to open or close the first suction return valve 162 in accordance with the temperature measured by the casing internal temperature sensor Ta. Specifically, the controller 406 opens the first suction return valve 162 to cool the interior of the casing 106 when the temperature measured by the casing internal temperature sensor Ta exceeds predetermined set temperature. When the first suction return valve 162 is opened, the liquid refrigerant flows from the pipe connecting the receiver 180 and the liquid-side shutoff valve 22 into the cooling heat exchanger 160. The liquid refrigerant flowed into the cooling heat exchanger 160 exchanges heat with air in the casing 106 to cool the air and evaporates.

The controller 406 assesses, before the first suction return valve 162 is actually opened to supply the cooling heat exchanger 160 with the refrigerant, whether or not the refrigerant flowing from the cooling heat exchanger 160 toward the compressor 110 comes into a wet state when the refrigerant is supplied to the cooling heat exchanger 160, and determines whether or not to open the first suction return valve 162 in accordance with an assessment result. Specifically, the controller 406 assesses whether or not the liquid refrigerant supplied to the cooling heat exchanger 160 entirely evaporates when the refrigerant is supplied to the cooling heat exchanger 160, and determines whether or not to open the first suction return valve 162 in accordance with an assessment result. In other words, the controller 406 assesses whether or not the refrigerant immediately after flowing out of the cooling heat exchanger 160 entirely comes into the gaseous state when the refrigerant is supplied to the cooling heat exchanger 160, and determines whether or not to open the first suction return valve 162 in accordance with an assessment result.

The controller 406 determines whether or not to open the first suction return valve 162 in accordance with pressure difference ΔP between the first pressure Pr1 derived by the first deriving unit 402 and the second pressure Pr2 derived by the second deriving unit 404. In other words, the controller 406 assesses whether or not the refrigerant flowing from the cooling heat exchanger 160 toward the compressor 110 comes into the wet state when the refrigerant is supplied to the cooling heat exchanger 160, and determines whether or not to open the first suction return valve 162 in accordance with an assessment result. The controller 406 also determines whether or not to open the first suction return valve 162 in accordance with the assessment result, based on the temperature measured by the casing internal temperature sensor Ta. In other words, the controller 406 assesses whether or not the refrigerant flowing from the cooling heat exchanger 160 toward the compressor 110 comes into the wet state when the refrigerant is supplied to the cooling heat exchanger 160, and determines whether or not to open the first suction return valve 162 in accordance with an assessment result.

Specifically, the controller 406 assesses whether or not the refrigerant immediately after flowing out of the cooling heat exchanger 160 entirely comes into the gaseous state in the following manner when the refrigerant is supplied to the cooling heat exchanger 160.

The controller 406 calculates the pressure difference ΔP (=Pr1−Pr2) between the current first pressure Pr1 derived by the first deriving unit 402 and the current second pressure Pr2 derived by the second deriving unit 404 before the first suction return valve 162 is opened to supply the cooling heat exchanger 160 with the refrigerant. The controller 406 then calculates a flow rate of the refrigerant expected to be supplied to the cooling heat exchanger 160 when the first suction return valve 162 is opened, in accordance with the pressure difference ΔP and information on a relation between pressure difference and a flow rate of a liquid refrigerant stored in the memory of the control unit 400. Examples of the information on the relation between the pressure difference and the flow rate of the liquid refrigerant stored in the memory of the control unit 400 include a preliminarily derived table indicating a relation between pressure difference and a flow rate, and a relational expression between the pressure difference and the flow rate.

Figure 6:
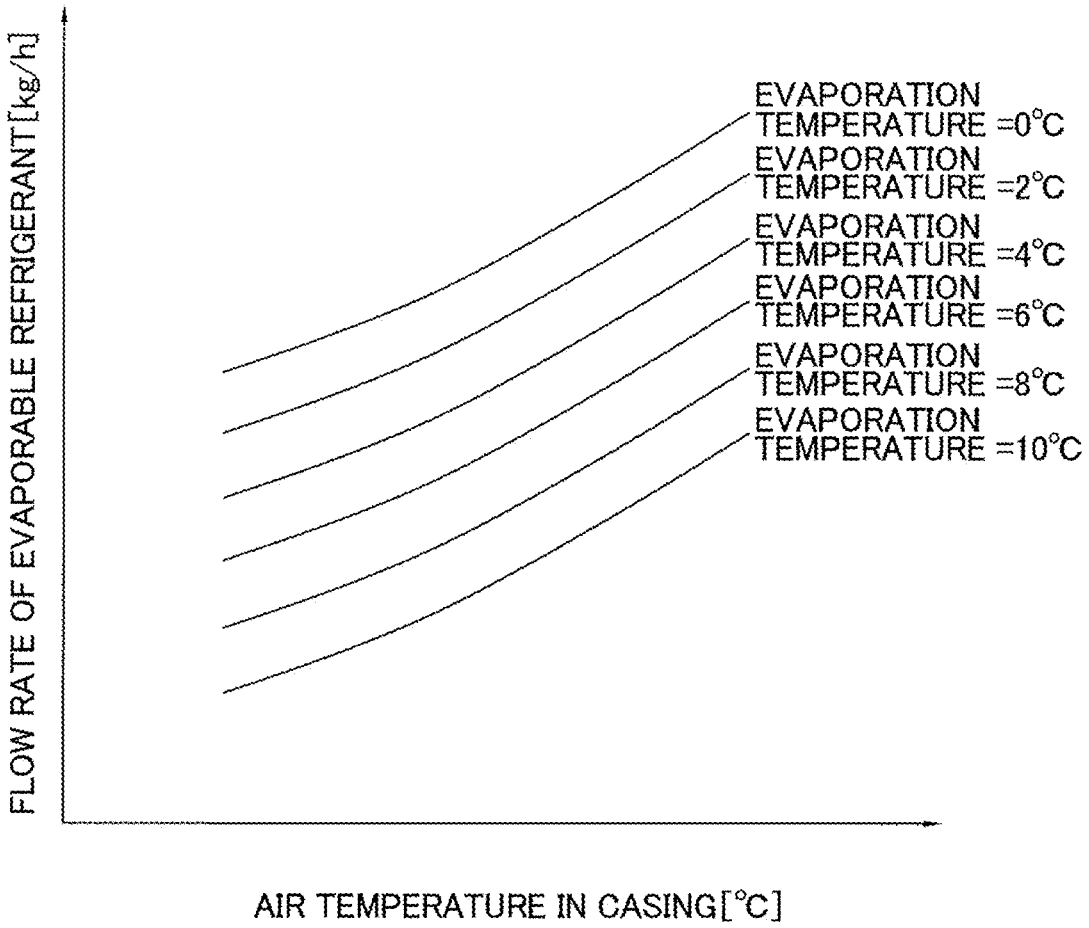
FIG. 6 is a conceptual graph indicating relations, at different evaporation temperature levels in a refrigeration cycle, between a flow rate of a refrigerant evaporable in a cooling heat exchanger of the heat source unit in the air conditioner depicted in FIG. 1 and air temperature in a casing of the heat source unit.

Further, the controller 406 calculates, before the first suction return valve 162 is opened to supply the cooling heat exchanger 160 with the refrigerant, quantity of the liquid refrigerant evaporable in the cooling heat exchanger 160 when the refrigerant is supplied to the cooling heat exchanger 160 in accordance with the temperature in the casing 106 measured by the casing internal temperature sensor Ta. More specifically, the controller 406 calculates a flow rate of the liquid refrigerant evaporable in the cooling heat exchanger 160 when the refrigerant is supplied to the cooling heat exchanger 160, in accordance with the temperature in the casing 106 measured by the casing internal temperature sensor Ta and the evaporation temperature in the refrigeration cycle. The controller 406 calculates quantity of the liquid refrigerant evaporable in the cooling heat exchanger 160 when the refrigerant is supplied to the cooling heat exchanger 160, from the evaporation temperature in the refrigeration cycle and the temperature in the casing 106 measured by the casing internal temperature sensor Ta, in accordance with a relation between the quantity of the liquid refrigerant evaporable in the cooling heat exchanger 160 and air temperature in the casing 106 at different evaporation temperature levels in the refrigeration cycle as indicated in FIG. 6 and stored in the memory of the control unit 400. The controller 406 calculates the evaporation temperature in the refrigeration cycle in accordance with the second pressure Pr2 measured by the pressure sensor P2 and the information on the relation between temperature and pressure of a refrigerant (e.g. the correspondence table on saturation temperature and pressure of the refrigerant) stored in the memory of the control unit 400. FIG. 6 conceptually indicates the relation between the quantity of the refrigerant evaporable in the cooling heat exchanger 160 and the air temperature in the casing 106 at the different evaporation temperature levels in the refrigeration cycle, and the memory of the control unit 400 may actually store information in the form of a table or a mathematical expression.

The controller 406 compares quantity (hereinafter called quantity A1) of the liquid refrigerant evaporable in the cooling heat exchanger 160 when the first suction return valve 162 is opened and quantity (hereinafter called quantity A2) of the liquid refrigerant expected to be supplied to the cooling heat exchanger 160 when the first suction return valve 162 is opened. In a case where the quantity A2≤the quantity A1 is established, the controller 406 assesses that the refrigerant immediately after flowing out of the cooling heat exchanger 160 entirely comes into the gaseous state when the refrigerant is supplied to the cooling heat exchanger 160. The controller 406 then determines to open the first suction return valve 162. In another case where the quantity A2>the quantity A1 is established, the controller 406 assesses that the refrigerant immediately after flowing out of the cooling heat exchanger 160 is partially in the liquid state when the refrigerant is supplied to the cooling heat exchanger 160. The controller 406 then determines not to open the first suction return valve 162 (to keep the first suction return valve 162 closed).

(3) Operation of Air Conditioner

Described below is operation of the air conditioner 10 when the utilization units 300A and 300B both execute cooling operation, when the utilization units 300A and 300B both execute heating operation, and when the utilization unit 300A executes cooling operation and the utilization unit 300B executes heating operation. The following description relates to an exemplary case where only the heat source unit 100A in the heat source units 100 operates.

Operation of the air conditioner 10 will be exemplified herein, and may be appropriately modified within a range in which the utilization units 300A and 300B can exhibit desired cooling and heating functions.

(3-1) When All Operated Utilization Units Execute Cooling Operation

The following description relates to the case where the utilization units 300A and 300B both execute cooling operation, in other words, where the utilization heat exchangers 310 in the utilization units 300A and 300B each function as a heat absorber (evaporator) for a refrigerant and the heat source-side heat exchanger 140 functions as a radiator (condenser) for a refrigerant.

The control unit 400 switches the first flow path switching mechanism 132 into the radiating operation state (the state indicated by the solid line of the first flow path switching mechanism 132 in FIG. 2) to cause the heat source-side heat exchanger 140 to function as a radiator for a refrigerant. The control unit 400 switches the second flow path switching mechanism 134 into the evaporation load operation state (the state indicated by the solid line of the second flow path switching mechanism 134 in FIG. 2). The control unit 400 appropriately controls the opening degrees of the heat source-side flow-rate control valve 150 and the second suction return valve 172. The control unit 400 further controls to bring the gas vent pipe flow-rate control valve 182 into a fully closed state. The control unit 400 brings the branching pipe control valves 220 into the closed state and brings the high and low-pressure valves 230 and the low pressure valves 240 into the opened state in the connection units 200A and 200B, to cause the utilization heat exchangers 310 in the utilization units 300A and 300B to each function as an evaporator for a refrigerant. When the control unit 400 brings the high and low-pressure valves 230 and the low pressure valves 240 into the opened state, the utilization heat exchangers 310 in the utilization units 300A and 300B and the suction side of the compressor 110 in the heat source unit 100A are connected via the high and low-pressure gas-refrigerant connection pipe 34 and the low-pressure gas-refrigerant connection pipe 36. The control unit 400 appropriately controls the opening degrees of the utilization flow-rate control valves 320 in the utilization units 300A and 300B.

Figure 7A:
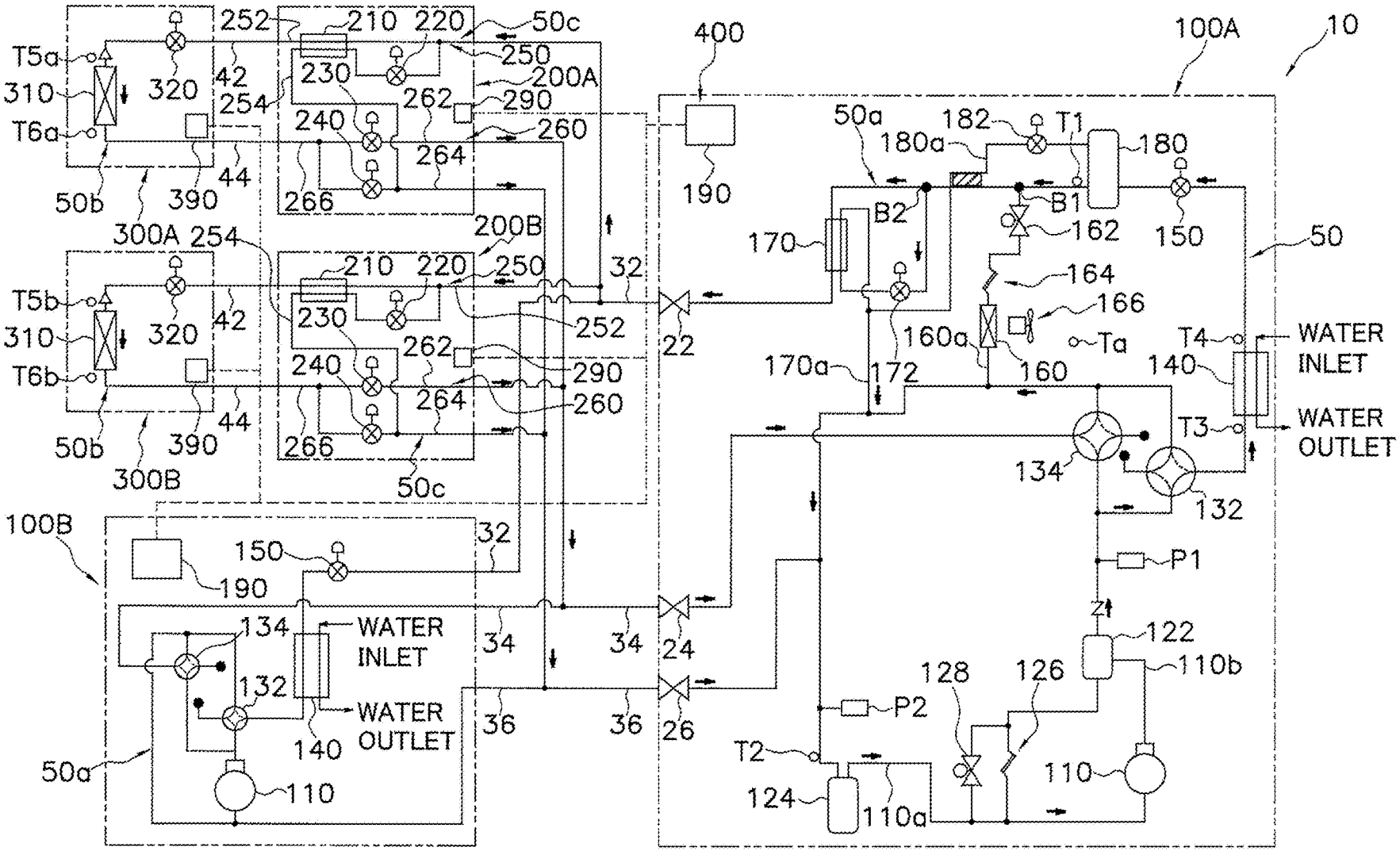
FIG. 7A is an explanatory diagram on a flow of the refrigerant in the refrigerant circuit in a case where two utilization units each execute cooling operation in the air conditioner depicted in FIG. 1.

The control unit 400 operates the respective units in the air conditioner 10 as described above to allow the refrigerant to circulate in the refrigerant circuit 50 as indicated by arrows in FIG. 7A.

The high-pressure gas refrigerant compressed by and discharged from the compressor 110 is sent to the heat source-side heat exchanger 140 via the first flow path switching mechanism 132. The high-pressure gas refrigerant sent to the heat source-side heat exchanger 140 radiates heat to be condensed through heat exchange with water as the heat source in the heat source-side heat exchanger 140. The refrigerant which radiated heat in the heat source-side heat exchanger 140 is flow-rate controlled by the heat source-side flow-rate control valve 150 and is then sent to the receiver 180. The refrigerant sent to the receiver 180 is temporarily stored in the receiver 180 and then flows out, and the refrigerant partially flows to the second suction return pipe 170*a* via the branching point B2 whereas the remaining thereof flows toward the liquid-refrigerant connection pipe 32. The refrigerant flowing from the receiver 180 to the liquid-refrigerant connection pipe 32 is cooled through heat exchange in the subcooling heat exchanger 170 with the refrigerant flowing through the second suction return pipe 170*a* toward the suction pipe 110*a* of the compressor 110, and then flows through the liquid-side shutoff valve 22 into the liquid-refrigerant connection pipe 32. The refrigerant sent to the liquid-refrigerant connection pipe 32 is branched into two ways to be sent to the main liquid refrigerant pipes 252 in the connection units 200A and 200B. The refrigerant sent to the main liquid refrigerant pipes 252 in the connection units 200A and 200B flows through the liquid connecting pipes 42 to be sent to the utilization flow-rate control valves 320 in the utilization units 300A and 300B. The refrigerant sent to each of the utilization flow-rate control valves 320 is flow-rate controlled by the utilization flow-rate control valve 320 and is then evaporated to become a low-pressure gas refrigerant through heat exchange in the utilization heat exchanger 310 with indoor air supplied from the indoor fan (not depicted). Meanwhile, the indoor air is cooled and is supplied into the room. The low-pressure gas refrigerant flowing out of the utilization heat exchangers 310 in the utilization units 300A and 300B is sent to the joined gas refrigerant pipes 266 in the connection units 200A and 200B. The low-pressure gas refrigerant sent to each of the joined gas refrigerant pipes 266 is sent to the high and low-pressure gas-refrigerant connection pipe 34 via the high and low-pressure gas refrigerant pipe 262 as well as to the low-pressure gas-refrigerant connection pipe 36 via the low-pressure gas refrigerant pipe 264. The low-pressure gas refrigerant sent to the high and low-pressure gas-refrigerant connection pipe 34 returns to the suction side (the suction pipe 110*a*) of the compressor 110 via the high and low-pressure gas-side shutoff valve 24 and the second flow path switching mechanism 134. The low-pressure gas refrigerant sent to the low-pressure gas-refrigerant connection pipe 36 returns to the suction side (the suction pipe 110*a*) of the compressor 110 via the low-pressure gas-side shutoff valve 26.

(3-2) When All Operated Utilization Units Execute Heating Operation

The following description relates to the case where the utilization units 300A and 300B both execute heating operation, in other words, where the utilization heat exchangers 310 in the utilization units 300A and 300B each function as a radiator (condenser) for a refrigerant and the heat source-side heat exchanger 140 functions as a heat absorber (evaporator) for a refrigerant.

The control unit 400 switches the first flow path switching mechanism 132 into an evaporating operation state (a state indicated by the broken line of the first flow path switching mechanism 132 in FIG. 2) to cause the heat source-side heat exchanger 140 to function as a heat absorber (evaporator) for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degree of the heat source-side flow-rate control valve 150. The control unit 400 brings the branching pipe control valves 220 and the low pressure valves 240 into the closed state and brings the high and low-pressure valves 230 into the opened state in the connection units 200A and 200B, to cause the utilization heat exchangers 310 in the utilization units 300A and 300B to each function as a radiator (condenser) for a refrigerant. When the control unit 400 brings the high and low-pressure valves 230 into the opened state, the discharge side of the compressor 110 and the utilization heat exchangers 310 in the utilization units 300A and 300B are connected via the high and low-pressure gas-refrigerant connection pipe 34. The control unit 400 appropriately controls the opening degrees of the utilization flow-rate control valves 320 in the utilization units 300A and 300B.

Figure 7B:
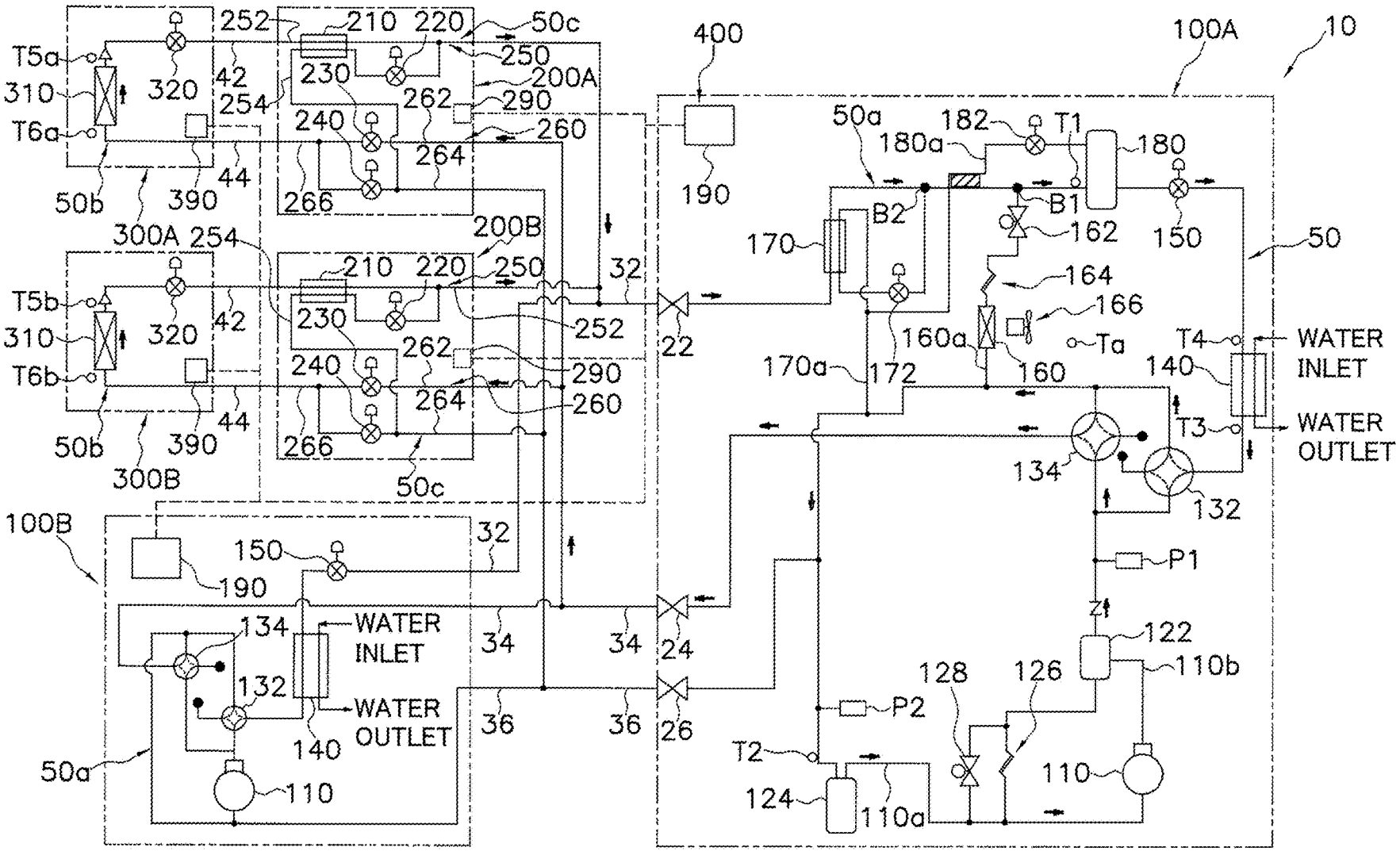
FIG. 7B is an explanatory diagram on a flow of the refrigerant in the refrigerant circuit in a case where the two utilization units each execute heating operation in the air conditioner depicted in FIG. 1.

The control unit 400 operates the respective units in the air conditioner 10 as described above to allow the refrigerant to circulate in the refrigerant circuit 50 as indicated by arrows in FIG. 7B.

The high-pressure gas refrigerant compressed by and discharged from the compressor 110 is sent to the high and low-pressure gas-refrigerant connection pipe 34 via the second flow path switching mechanism 134 and the high and low-pressure gas-side shutoff valve 24. The high-pressure gas refrigerant sent to the high and low-pressure gas-refrigerant connection pipe 34 branches to flow into the high and low-pressure gas refrigerant pipes 262 in the connection units 200A and 200B. The high-pressure gas refrigerant flowed into the high and low-pressure gas refrigerant pipes 262 is sent to the utilization heat exchanger 310 in each of the utilization units 300A and 300B via the high and low-pressure valve 230, the joined gas refrigerant pipe 266, and the gas connecting pipe 44. The high-pressure gas refrigerant sent to the utilization heat exchanger 310 radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchangers 310 in the utilization units 300A and 300B is flow-rate controlled by the utilization flow-rate control valves 320 in the utilization units 300A and 300B and is then sent to the main liquid refrigerant pipes 252 in the connection units 200A and 200B via the liquid connecting pipes 42. The refrigerant sent to the main liquid refrigerant pipes 252 is sent to the liquid-refrigerant connection pipe 32 and is then sent to the receiver 180 through the liquid-side shutoff valve 22. The refrigerant sent to the receiver 180 is temporarily stored in the receiver 180 and then flows out to be sent to the heat source-side flow-rate control valve 150. The refrigerant sent to the heat source-side flow-rate control valve 150 is evaporated to become a low-pressure gas refrigerant through heat exchange with water as the heat source in the heat source-side heat exchanger 140 and is sent to the first flow path switching mechanism 132. The low-pressure gas refrigerant sent to the first flow path switching mechanism 132 then returns to the suction side (the suction pipe 110*a*) of the compressor 110.

(3-3) When Simultaneous Cooling and Heating Operation is Executed (a) Mainly with Evaporation Load Described below is operation of the air conditioner 10 during simultaneous cooling and heating operation with a superior evaporation load of the utilization units 300. A superior evaporation load in the utilization units 300 is caused, for example, in a case where a large number of utilization units mostly execute cooling operation and the remaining small number of the utilization units execute heating operation. The following description relates to an exemplary case where there are provided only two utilization units 300 and the utilization unit 300A including the utilization heat exchanger 310 functioning as an evaporator for a refrigerant has a cooling load larger than a heating load of the utilization unit 300B including the utilization heat exchanger 310 functioning as a radiator for a refrigerant.

In this case, the control unit 400 switches the first flow path switching mechanism 132 into the radiating operation state (the state indicated by the solid line of the first flow path switching mechanism 132 in FIG. 2) to cause the heat source-side heat exchanger 140 to function as a radiator for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degrees of the heat source-side flow-rate control valve 150 and the second suction return valve 172. The control unit 400 further controls to bring the gas vent pipe flow-rate control valve 182 into a fully closed state. The control unit 400 brings the branching pipe control valve 220 and the high and low-pressure valve 230 into the closed state and brings the low pressure valve 240 into the opened state in the connection unit 200A, to cause the utilization heat exchanger 310 in the utilization unit 300A to function as an evaporator for a refrigerant. The control unit 400 brings the branching pipe control valve 220 and the low pressure valve 240 into the closed state and brings the high and low-pressure valve 230 into the opened state in the connection unit 200B, to cause the utilization heat exchanger 310 in the utilization unit 300B to function as a radiator for a refrigerant. When the valves are controlled as described above in the connection unit 200A, the utilization heat exchanger 310 in the utilization unit 300A and the suction side of the compressor 110 in the heat source unit 100A are connected via the low-pressure gas-refrigerant connection pipe 36. When the valves are controlled as described above in the connection unit 200B, the discharge side of the compressor 110 in the heat source unit 100A and the utilization heat exchanger 310 in the utilization unit 300B are connected via the high and low-pressure gas-refrigerant connection pipe 34. The control unit 400 appropriately controls the opening degrees of the utilization flow-rate control valves 320 in the utilization units 300A and 300B.

Figure 7C:
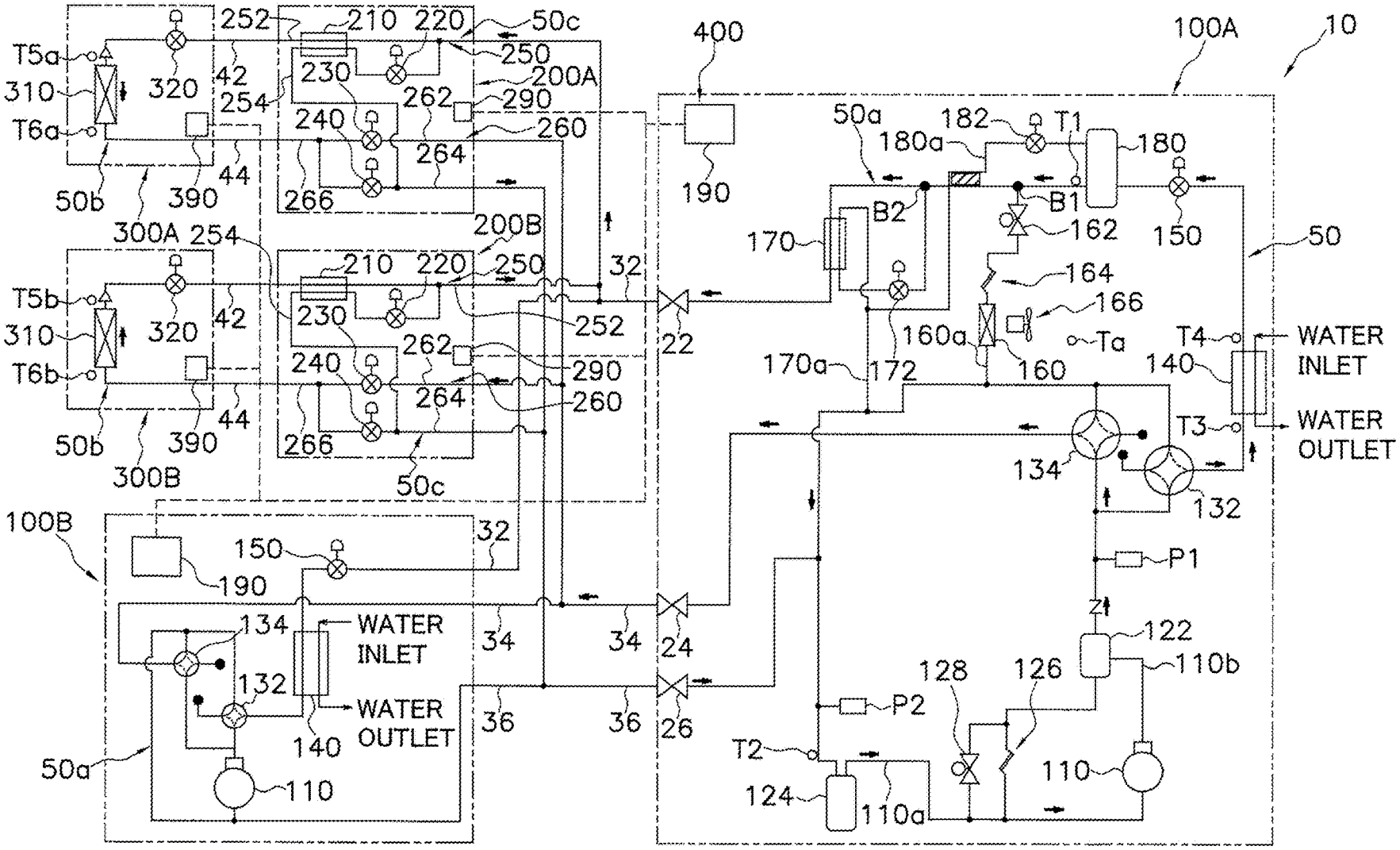
FIG. 7C is an explanatory diagram on a flow of the refrigerant in the refrigerant circuit in a case where one of the utilization units executes cooling operation and the other one of the utilization units executes heating operation in the air conditioner depicted in FIG. 1 mainly with an evaporation load.

The control unit 400 operates the respective units in the air conditioner 10 as described above to allow the refrigerant to circulate in the refrigerant circuit 50 as indicated by arrows in FIG. 7C.

The high-pressure gas refrigerant compressed by and discharged from the compressor 110 is partially sent to the high and low-pressure gas-refrigerant connection pipe 34 via the second flow path switching mechanism 134 and the high and low-pressure gas-side shutoff valve 24, and the remaining thereof is sent to the heat source-side heat exchanger 140 via the first flow path switching mechanism 132.

The high-pressure gas refrigerant sent to the high and low-pressure gas-refrigerant connection pipe 34 is sent to the high and low-pressure gas refrigerant pipe 262 in the connection unit 200B. The high-pressure gas refrigerant sent to the high and low-pressure gas refrigerant pipe 262 is sent to the utilization heat exchanger 310 in the utilization unit 300B via the high and low-pressure valve 230 and the joined gas refrigerant pipe 266. The high-pressure gas refrigerant sent to the utilization heat exchanger 310 in the utilization unit 300B radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchanger 310 in the utilization unit 300B is flow-rate controlled by the utilization flow-rate control valve 320 in the utilization unit 300B and is then sent to the main liquid refrigerant pipe 252 in the connection unit 200B. The refrigerant sent to the main liquid refrigerant pipe 252 in the connection unit 200B is sent to the liquid-refrigerant connection pipe 32.

The high-pressure gas refrigerant sent to the heat source-side heat exchanger 140 radiates heat to be condensed through heat exchange with water as the heat source in the heat source-side heat exchanger 140. The refrigerant which radiated heat in the heat source-side heat exchanger 140 is flow-rate controlled by the heat source-side flow-rate control valve 150 and is then sent to the receiver 180. The refrigerant sent to the receiver 180 is temporarily stored in the receiver 180 and then flows out, and the refrigerant partially flows to the second suction return pipe 170*a* via the branching point B2 whereas the remaining thereof flows toward the liquid-refrigerant connection pipe 32. The refrigerant flowing from the receiver 180 to the liquid-refrigerant connection pipe 32 is cooled through heat exchange in the subcooling heat exchanger 170 with the refrigerant flowing through the second suction return pipe 170*a* toward the suction pipe 110*a* of the compressor 110, and then flows through the liquid-side shutoff valve 22 into the liquid-refrigerant connection pipe 32. The refrigerant flowing into the liquid-refrigerant connection pipe 32 via the liquid-side shutoff valve 22 joins the refrigerant flowing from the main liquid refrigerant pipe 252 in the connection unit 200B.

The refrigerant in the liquid-refrigerant connection pipe 32 is sent to the main liquid refrigerant pipe 252 in the connection unit 200A. The refrigerant sent to the main liquid refrigerant pipe 252 in the connection unit 200A is sent to the utilization flow-rate control valve 320 in the utilization unit 300A. The refrigerant sent to the utilization flow-rate control valve 320 in the utilization unit 300A is flow-rate controlled by the utilization flow-rate control valve 320 and is then evaporated to become a low-pressure gas refrigerant through heat exchange with indoor air supplied from the indoor fan in the utilization heat exchanger 310 of the utilization unit 300A. Meanwhile, the indoor air is cooled and is supplied into the room. The low-pressure gas refrigerant flowing out of the utilization heat exchanger 310 in the utilization unit 300A is sent to the joined gas refrigerant pipe 266 in the connection unit 200A. The low-pressure gas refrigerant sent to the joined gas refrigerant pipe 266 in the connection unit 200A is sent to the low-pressure gas-refrigerant connection pipe 36 via the low-pressure gas refrigerant pipe 264 in the connection unit 200A. The low-pressure gas refrigerant sent to the low-pressure gas-refrigerant connection pipe 36 returns to the suction side (the suction pipe 110*a*) of the compressor 110 via the low-pressure gas-side shutoff valve 26.

(b) Mainly with Radiation Load

Described below is operation of the air conditioner 10 during simultaneous cooling and heating operation with a superior radiation load of the utilization units 300. The utilization units 300 have a superior radiation load in an exemplary case where a large number of utilization units mostly execute heating operation and the remaining small number of the utilization units execute cooling operation. The following description relates to an exemplary case where there are provided only two utilization units 300 and the utilization unit 300B including the utilization heat exchanger 310 functioning as a radiator for a refrigerant has a heating load larger than a cooling load of the utilization unit 300A including the utilization heat exchanger 310 functioning as an evaporator for a refrigerant.

In this case, the control unit 400 switches the first flow path switching mechanism 132 into the evaporating operation state (the state indicated by the broken line of the first flow path switching mechanism 132 in FIG. 2) to cause the heat source-side heat exchanger 140 to function as an evaporator for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degree of the heat source-side flow-rate control valve 150. The control unit 400 brings the high and low-pressure valve 230 into the closed state and brings the low pressure valve 240 into the opened state in the connection unit 200A, to cause the utilization heat exchanger 310 in the utilization unit 300A to function as an evaporator for a refrigerant. The control unit 400 appropriately controls the opening degree of the branching pipe control valve 220 in the connection unit 200A. The control unit 400 brings the branching pipe control valve 220 and the low pressure valve 240 into the closed state and brings the high and low-pressure valve 230 into the opened state in the connection unit 200B, to cause the utilization heat exchanger 310 in the utilization unit 300B to function as a radiator for a refrigerant. When the valves are controlled as described above in the connection units 200A and 200B, the utilization heat exchanger 310 in the utilization unit 300A and the suction side of the compressor 110 in the heat source unit 100A are connected via the low-pressure gas-refrigerant connection pipe 36. When the valves are controlled as described above in the connection units 200 A and 200B, the discharge side of the compressor 110 in the heat source unit 100A and the utilization heat exchanger 310 in the utilization unit 300B are connected via the high and low-pressure gas-refrigerant connection pipe 34. The control unit 400 appropriately controls the opening degrees of the utilization flow-rate control valves 320 in the utilization units 300A and 300B.

Figure 7D:
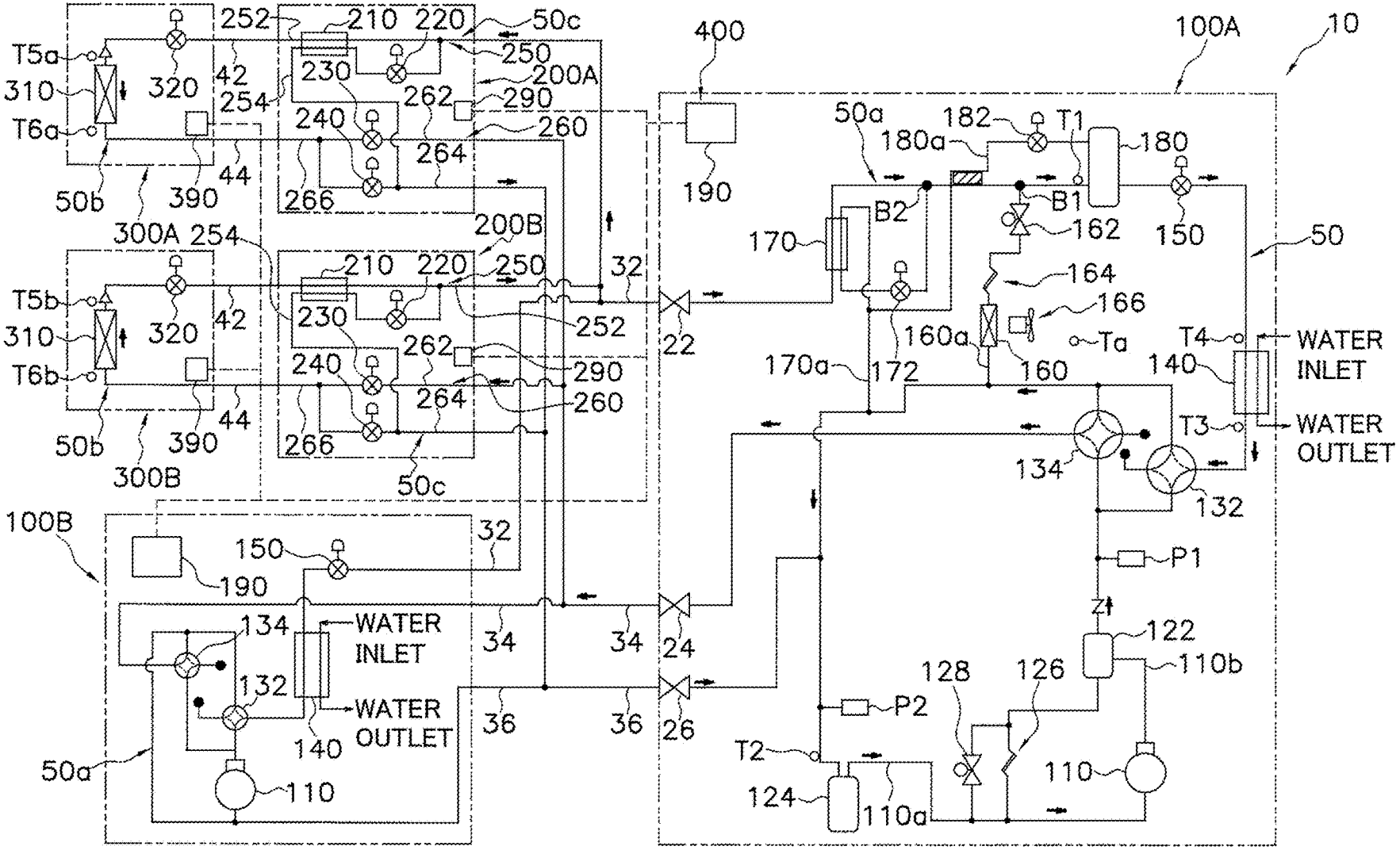
FIG. 7D is an explanatory diagram on a flow of the refrigerant in the refrigerant circuit in a case where one of the utilization units executes cooling operation and the other one of the utilization units executes heating operation in the air conditioner depicted in FIG. 1 mainly with a radiation load.

The control unit 400 operates the respective units in the air conditioner 10 as described above to allow the refrigerant to circulate in the refrigerant circuit 50 as indicated by arrows in FIG. 7D.

The high-pressure gas refrigerant compressed by and discharged from the compressor 110 is sent to the high and low-pressure gas-refrigerant connection pipe 34 via the second flow path switching mechanism 134 and the high and low-pressure gas-side shutoff valve 24. The high-pressure gas refrigerant sent to the high and low-pressure gas-refrigerant connection pipe 34 is sent to the high and low-pressure gas refrigerant pipe 262 in the connection unit 200B. The high-pressure gas refrigerant sent to the high and low-pressure gas refrigerant pipe 262 is sent to the utilization heat exchanger 310 in the utilization unit 300B via the high and low-pressure valve 230 and the joined gas refrigerant pipe 266. The high-pressure gas refrigerant sent to the utilization heat exchanger 310 in the utilization unit 300B radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchanger 310 in the utilization unit 300B is flow-rate controlled by the utilization flow-rate control valve 320 in the utilization unit 300B and is then sent to the main liquid refrigerant pipe 252 in the connection unit 200B. The refrigerant sent to the main liquid refrigerant pipe 252 in the connection unit 200B is sent to the liquid-refrigerant connection pipe 32. The refrigerant in the liquid-refrigerant connection pipe 32 is partly sent to the main liquid refrigerant pipe 252 in the connection unit 200A and the remaining thereof is sent to the receiver 180 via the liquid-side shutoff valve 22.

The refrigerant sent to the main liquid refrigerant pipe 252 in the connection unit 200A partially flows to the branching liquid refrigerant pipe 254 and the remaining thereof flows toward the utilization flow-rate control valve 320 in the utilization unit 300A. The refrigerant flowing through the main liquid refrigerant pipe 252 toward the utilization flow-rate control valve 320 is cooled through heat exchange in the subcooling heat exchanger 210 with the refrigerant flowing through the branching liquid refrigerant pipe 254 toward the low-pressure gas refrigerant pipe 264, and then flows into the utilization flow-rate control valve 320. The refrigerant sent to the utilization flow-rate control valve 320 in the utilization unit 300A is flow-rate controlled by the utilization flow-rate control valve 320 in the utilization unit 300A and is then evaporated to become a low-pressure gas refrigerant through heat exchange with indoor air supplied from the indoor fan in the utilization heat exchanger 310 of the utilization unit 300A. Meanwhile, the indoor air is cooled and is supplied into the room. The low-pressure gas refrigerant flowing out of the utilization heat exchanger 310 is sent to the joined gas refrigerant pipe 266 in the connection unit 200A. The low-pressure gas refrigerant sent to the joined gas refrigerant pipe 266 flows into the low-pressure gas refrigerant pipe 264, and joins the refrigerant flowing from the branching liquid refrigerant pipe 254 to be sent to the low-pressure gas-refrigerant connection pipe 36. The low-pressure gas refrigerant sent to the low-pressure gas-refrigerant connection pipe 36 returns to the suction side (the suction pipe 110*a*) of the compressor 110 via the low-pressure gas-side shutoff valve 26.

The refrigerant sent from the liquid-refrigerant connection pipe 32 to the receiver 180 is temporarily stored in the receiver 180 and then flows out to be sent to the heat source-side flow-rate control valve 150. The refrigerant sent to the heat source-side flow-rate control valve 150 is evaporated to become a low-pressure gas refrigerant through heat exchange with water as the heat source in the heat source-side heat exchanger 140 and is sent to the first flow path switching mechanism 132. The low-pressure gas refrigerant sent to the first flow path switching mechanism 132 then returns to the suction side (the suction pipe 110*a*) of the compressor 110.

(4) Control to Open or Close First Suction Return Valve

Control to open or close the first suction return valve 162 by the control unit 400 will be described next with reference to a flowchart in FIG. 8. Assume that the first suction return valve 162 is closed when step S1 described below starts.

The controller 406 initially determines whether or not the temperature in the casing 106 measured by the casing internal temperature sensor Ta is higher than the predetermined set temperature (step S1). The set temperature may have a value preliminarily stored in the memory of the control unit 400, or a value set by the user of the air conditioner 10 with use of the operation unit (not depicted) of the air conditioner 10. The process proceeds to step S2 if the temperature in the casing 106 measured by the casing internal temperature sensor Ta is higher than the predetermined set temperature. Step S1 is repeated until the temperature in the casing 106 measured by the casing internal temperature sensor Ta is determined as being higher than the predetermined set temperature.

Subsequently in step S2, the controller 406 calculates evaporation temperature in the refrigeration cycle in accordance with the information on the relation between temperature and pressure of a refrigerant stored in the memory of the control unit 400 and a low pressure value in the refrigeration cycle measured by the low pressure sensor P2.

Subsequently in step S3, the controller 406 calculates the quantity A1 of a liquid refrigerant evaporable in the cooling heat exchanger 160 when the refrigerant is supplied to the cooling heat exchanger 160, in accordance with the evaporation temperature in the refrigeration cycle calculated in step S2, the temperature in the casing 106 measured by the casing internal temperature sensor Ta, and the information on the relation between the quantity of the refrigerant evaporable in the cooling heat exchanger 160 and air temperature in the casing 106 at different evaporation temperature levels in the refrigeration cycle stored in the memory of the control unit 400.

Subsequently in step S4, the controller 406 calculates the pressure difference ΔP between the first pressure Pr1 and the second pressure Pr2 using the first pressure Pr1 derived by the first deriving unit 402 and the second pressure Pr2 derived by the second deriving unit 404.

Subsequently in step S5, the controller 406 calculates the quantity A2 (flow rate) of the refrigerant expected to be supplied to the cooling heat exchanger 160 when the first suction return valve 162 is opened, in accordance with the pressure difference ΔP calculated in step S4 and the information on the relation between pressure difference and a flow rate of a liquid refrigerant stored in the memory of the control unit 400.

Subsequently in step S6, the controller 406 compares the quantity A1 of the liquid refrigerant evaporable in the cooling heat exchanger 160 when the refrigerant is supplied to the cooling heat exchanger 160 and the quantity A2 of the refrigerant expected to be supplied to the cooling heat exchanger 160 when the first suction return valve 162 is opened. The process proceeds to step S7 if the quantity A2≤the quantity A1 is established. If the quantity A2>the quantity A1 is established, the controller 406 keeps the first suction return valve 162 closed (i.e. does not open the first suction return valve 162), and the process returns to step S2.

In step S7, the controller 406 opens the first suction return valve 162. The process subsequently proceeds to step S8.

In step S8, the controller 406 determines whether or not the temperature in the casing 106 measured by the casing internal temperature sensor Ta is less than a value obtained by subtracting a value α from the predetermined set temperature. The value α has a predetermined positive value. Although the value α may alternatively be zero, the value α having an appropriate positive value leads to preventing the first suction return valve 162 from frequently opening and closing. When the temperature in the casing 106 is less than the value obtained by subtracting the value α from the set temperature, the process proceeds to step S9. The processing in step S8 is repeated until the temperature in the casing 106 is assessed as being less than the value obtained by subtracting the value α from the set temperature.

In step S9, the controller 406 closes the first suction return valve 162. The process subsequently returns to step S1.

(5) Characteristics (5-1)

The air conditioner 10 exemplifying the refrigeration apparatus according to the embodiment described above includes the heat source unit 100, the utilization unit 300, and the controller 406. The heat source unit 100 includes the compressor 110, the heat source-side heat exchanger 140 exemplifying the main heat exchanger, the casing 106, the cooling heat exchanger 160, and the first suction return valve 162. The compressor 110 compresses a refrigerant. The heat source-side heat exchanger 140 causes heat exchange between the refrigerant and a heat source. The casing 106 accommodates the compressor 110 and the heat source-side heat exchanger 140. The cooling heat exchanger 160 is supplied with the refrigerant to cool the interior of the casing 106. The first suction return valve 162 switches to supply or not to supply the cooling heat exchanger 160 with the refrigerant. The utilization unit 300 includes the utilization heat exchanger 310. The utilization unit 300 and the heat source unit 100 constitute the refrigerant circuit 50. The controller 406 controls to open or close the first suction return valve 162. The controller 406 assesses, before the first suction return valve 162 is opened to supply the cooling heat exchanger 160 with the refrigerant, whether or not the refrigerant flowing from the cooling heat exchanger 160 toward the compressor 110 comes into the wet state when the refrigerant is supplied to the cooling heat exchanger 160, and determines whether or not to open the first suction return valve 162 in accordance with an assessment result.

In the present air conditioner 10, it is determined whether to open or not to open the first suction return valve 162 for switching between supply and non-supply of the refrigerant to the cooling heat exchanger 160 in accordance with the assessment result as to whether or not the refrigerant that flows from the cooling heat exchanger 160 used to cool the interior of the casing 106 toward the compressor 110 will come into the wet state. This configuration achieves a highly reliable air conditioner 10 that can reduce the liquid compression caused by supply of the refrigerant to the cooling heat exchanger 160.

(5-2)

In the air conditioner 10 according to the above embodiment, the controller 406 assesses whether or not the refrigerant flowing out of the cooling heat exchanger 160 entirely comes into the gaseous state when the refrigerant is supplied to the cooling heat exchanger 160, and determines whether or not to open the first suction return valve 162 in accordance with an assessment result.

In the present air conditioner 10, whether or not to open the first suction return valve 162 configured to switch to supply or not to supply the cooling heat exchanger 160 with the refrigerant is determined in accordance with the assessment result as to whether or not the refrigerant immediately after flowing out of the cooling heat exchanger 160 entirely comes into the gaseous state. This configuration thus particularly facilitates reduction of liquid compression caused by supply of the refrigerant to the cooling heat exchanger 160.

(5-3)

The air conditioner 10 according to the above embodiment includes the first deriving unit 402 and the second deriving unit 404. The first deriving unit 402 derives the first pressure Pr1 upstream of the first suction return valve 162 in the refrigerant flow direction F of the refrigerant flowing to the cooling heat exchanger 160 when the first suction return valve 162 is opened. The second deriving unit 404 derives the second pressure Pr2 downstream of the cooling heat exchanger 160 in the refrigerant flow direction F. The controller 406 determines whether or not to open the first suction return valve 162 in accordance with the pressure difference ΔP between the first pressure Pr1 and the second pressure Pr2.

In the present air conditioner 10, whether or not to open the first suction return valve 162 is determined in accordance with a highly accurate assessment result with reference to the pressure difference ΔP between the first pressure Pr1 and the second pressure Pr2 correlated with quantity of the refrigerant flowing in the cooling heat exchanger 160 when the first suction return valve 162 is opened. The air conditioner 10 thus achieves high reliability in which the occurrence of liquid compression can be reduced.

(5-4)

The air conditioner 10 according to the above embodiment includes the casing internal temperature sensor Ta exemplifying a temperature measurement unit. The casing internal temperature sensor Ta measures temperature in the casing 106. The controller 406 determines whether or not to open the first suction return valve 162 in accordance with the temperature in the casing 106.

In the present air conditioner 10, whether or not to open the first suction return valve 162 is determined in accordance with highly accurate assessment as to whether or not the refrigerant flowing from the cooling heat exchanger 160 toward the compressor 110 comes into the wet state when the refrigerant is supplied to the cooling heat exchanger 160, with reference to the temperature in the casing 106 correlated with quantity of heat supplied to the refrigerant in the cooling heat exchanger 160. The air conditioner 10 thus achieves high reliability in which the occurrence of liquid compression can be reduced.

(5-5)

In the air conditioner 10 according to the above embodiment, the cooling heat exchanger 160 is disposed on the first suction return pipe 160*a* connecting the pipe connecting between the heat source-side heat exchanger 140 and the utilization heat exchanger 310 and the suction pipe 110*a* of the compressor 110.

The present air conditioner 10 achieves high reliability so as to reduce the occurrence of liquid compression caused by the refrigerant flowing from the cooling heat exchanger 160 to the suction pipe 110*a*.

(5-6)

In the air conditioner 10 according to the above embodiment, the heat source of the heat source unit 100 is water.

The air conditioner 10 thus can achieve control of the temperature in the casing 106 at predetermined temperature even in a case where the air conditioner 10 utilizes water as the heat source and is likely to have heat accumulated in the casing 106

(6) Modification Examples

The modification examples of the above embodiment will be described hereinafter. Any of the following modification examples may be combined where appropriate within a range causing no contradiction.

(6-1) Modification Example A

According to the above embodiment, the controller 406 in the control unit 400 assesses whether or not the refrigerant immediately after flowing out of the cooling heat exchanger 160 entirely comes into the gaseous state when the refrigerant is supplied to the cooling heat exchanger 160, and determines whether or not to open the first suction return valve 162 in accordance with an assessment result. The present invention should not be limited to this configuration, but the air conditioner may alternatively be configured in the following manner.

An air conditioner according to the modification example A includes a control unit 400*a* in place of the control unit 400. The air conditioner according to the modification example A is physically configured similarly to the air conditioner 10 according to the above embodiment, and operates similarly to the air conditioner 10 according to the above embodiment except for control of the first suction return valve 162 by the control unit 400*a*. Description is accordingly made herein to only the control of the first suction return valve 162 by the control unit 400*a*, and the remaining features will not be described repeatedly.

The control unit 400*a* includes a microcomputer having, as functional units relevant to control to open or close the first suction return valve 162, the first deriving unit 402, the second deriving unit 404, a controller 406*a*, and a superheating degree deriving unit 408 as depicted in FIG. 5. The first deriving unit 402 and the second deriving unit 404 are configured similarly to those according to the above embodiment and thus will not be described repeatedly.

The controller 406*a* according to the modification example A assesses whether or not the refrigerant that is obtained after mixing the refrigerant flowing out of the cooling heat exchanger 160 and the refrigerant returning from the utilization unit 300 and that flows toward the compressor 110 comes into the wet state when the refrigerant is supplied to the cooling heat exchanger 160, and determines whether or not to open the first suction return valve 162 in accordance with an assessment result. The refrigerant returning from the utilization unit 300 and flowing toward the compressor 110 includes the refrigerant flowing from the utilization heat exchanger 310 into the suction pipe 110*a* without passing through any other heat exchanger, and also the refrigerant flowing from the utilization heat exchanger 310 into the suction pipe 110*a* via the heat source-side heat exchanger 140.

According to the above embodiment, whether or not the refrigerant immediately after flowing out of the cooling heat exchanger 160 entirely comes into the gaseous state when the refrigerant is supplied to the cooling heat exchanger 160 is assessed in order for assessment as to whether or not the refrigerant flowing from the cooling heat exchanger 160 toward the compressor 110 comes into the wet state when the refrigerant is supplied to the cooling heat exchanger 160. In contrast, according to the modification example A, if the refrigerant that is obtained after mixing the refrigerant flowing out of the cooling heat exchanger 160 and the refrigerant returning from the utilization unit 300 and that flows toward the compressor 110 is assessed as not coming into the wet state, the refrigerant flowing from the cooling heat exchanger 160 toward the compressor 110 is assessed as not coming into the wet state even in a case where the refrigerant is supplied to the cooling heat exchanger 160 and the refrigerant immediately after flowing out of the cooling heat exchanger 160 does not entirely come into the gaseous state (comes into the wet state). Assessment by the controller 406*a* will be described later.

The superheating degree deriving unit 408 derives a degree of superheating of the refrigerant returning from the utilization unit 300 to the suction pipe 110*a*. The superheating degree deriving unit 408 derives the degree of superheating of the refrigerant returning from the utilization unit 300 to the suction pipe 110*a* in the following exemplary manner.

Assume an exemplary case where the utilization units 300A and 300B both execute cooling operation (where the utilization heat exchangers 310 each function as an evaporator).

The superheating degree deriving unit 408 calculates a degree of superheating of the refrigerant returning from the utilization unit 300A to the suction pipe 110*a* with reference to the liquid-side temperature sensor T5*a* and the gas-side temperature sensor T6*a* in the utilization unit 300A (by subtracting temperature measured by the liquid-side temperature sensor T5*a* from temperature measured by the gas-side temperature sensor T6*a*). The superheating degree deriving unit 408 also calculates a degree of superheating of the refrigerant returning from the utilization unit 300B to the suction pipe 110*a* with reference to the liquid-side temperature sensor T5*b* and the gas-side temperature sensor T6*b* in the utilization unit 300B. Quantity balance between the refrigerants supplied to the utilization heat exchangers 310 in the utilization units 300A and 300B can be assessed in accordance with capacity of the utilization heat exchanger 310 in the utilization unit 300A and capacity of the utilization heat exchanger 310 in the utilization unit 300B. The superheating degree deriving unit 408 can thus calculate the degree of superheating of the refrigerant returning from each of the utilization units 300 to the suction pipe 110*a* in accordance with the capacity of the utilization units 300A and 300B stored in the memory of the control unit 400 and the degree of superheating of the refrigerant at the outlet of the utilization heat exchanger 310 in each of the utilization units 300A and 300B. Assuming that the utilization unit 300B has capacity (horsepower) two times of capacity of the utilization unit 300A, the superheating degree deriving unit 408 can calculate the degree of superheating of the refrigerant returning from each of the utilization units 300 to the suction pipe 110*a* through calculation of (the degree of superheating in the utilization unit 300A+ the degree of superheating in the utilization unit 300B×2)/3.

Assume another case where the utilization units 300A and 300B both execute heating operation (where the utilization heat exchangers 310 each function as a radiator).

In this case, the superheating degree deriving unit 408 calculates the degree of superheating of the refrigerant returning from each of the utilization units 300 to the suction pipe 110*a* with reference to the liquid-side temperature sensor T4 and the gas-side temperature sensor T3 in the heat source unit 100A (by subtracting temperature measured by the liquid-side temperature sensor T4 from temperature measured by the gas-side temperature sensor T3).

Figure 10:
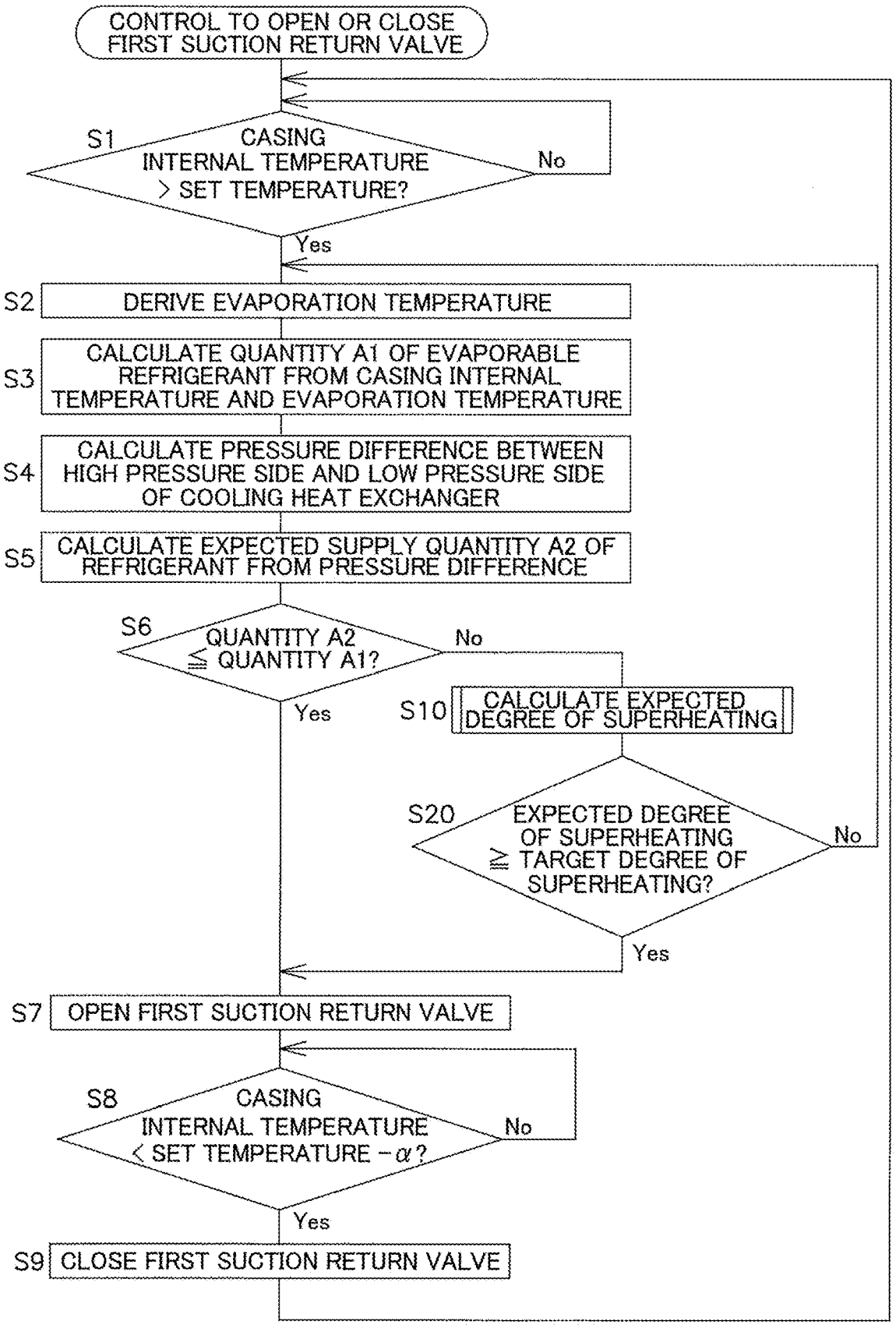
FIG. 10 is an explanatory flowchart of a flow of controlling the first suction return valve by the control unit depicted in FIG. 9.
Figure 11:
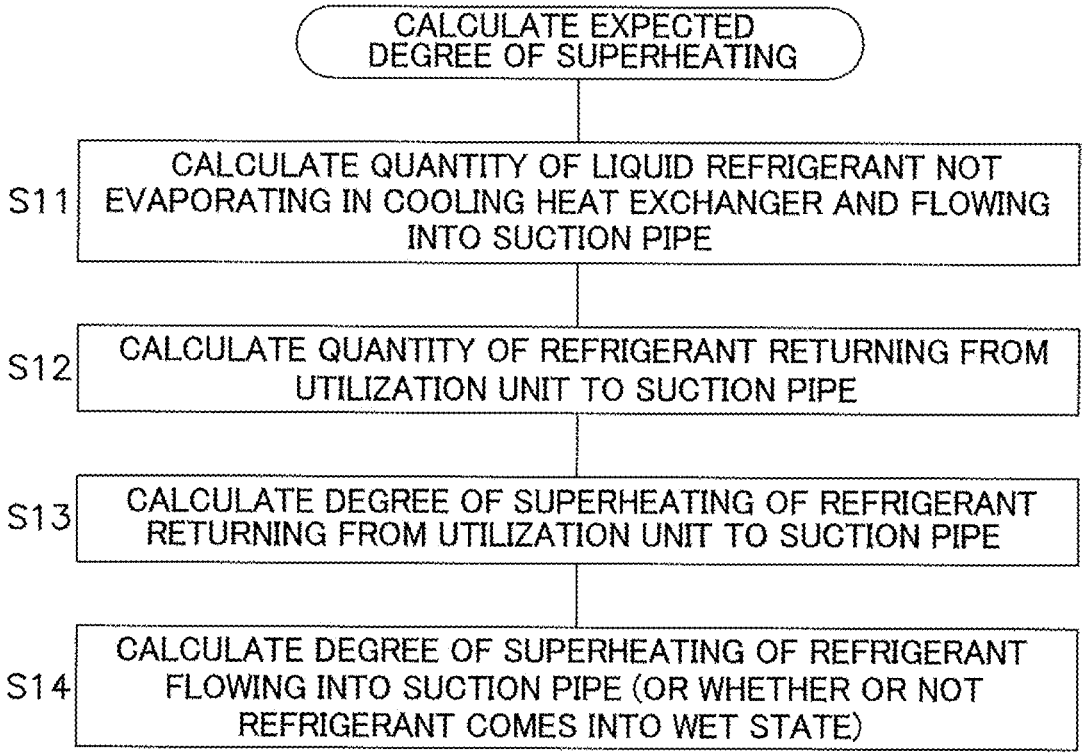
FIG. 11 is an explanatory flowchart of a flow of calculating an expected degree of superheating by the control unit depicted in FIG. 9.

Control to open or close the first suction return valve 162 by the control unit 400*a* will be described next with reference to flowcharts in FIG. 10 and FIG. 11.

Figure 8:
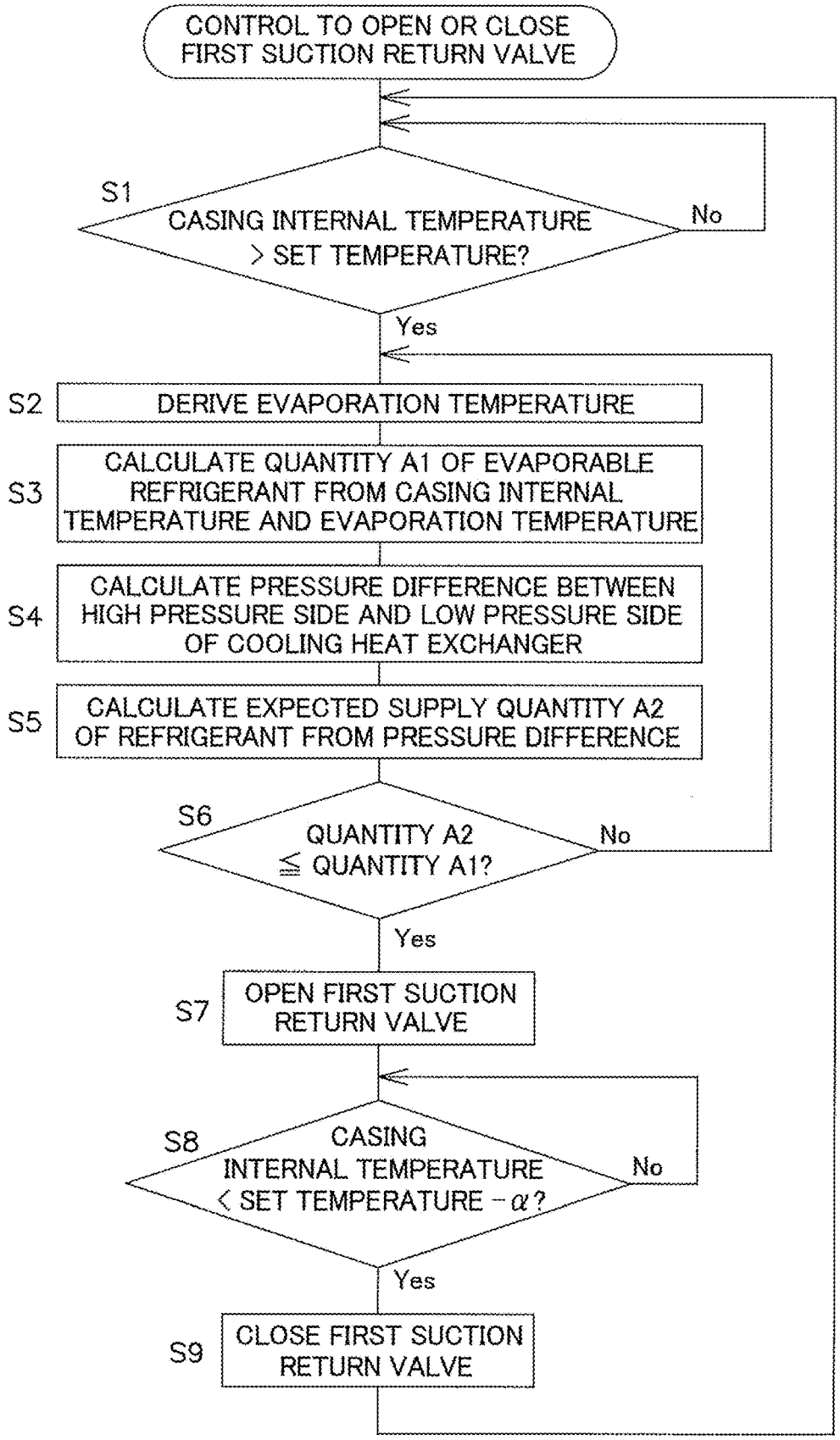
FIG. 8 is an explanatory flowchart of a flow of controlling the first suction return valve by the control unit depicted in FIG. 5.
Figure 9:
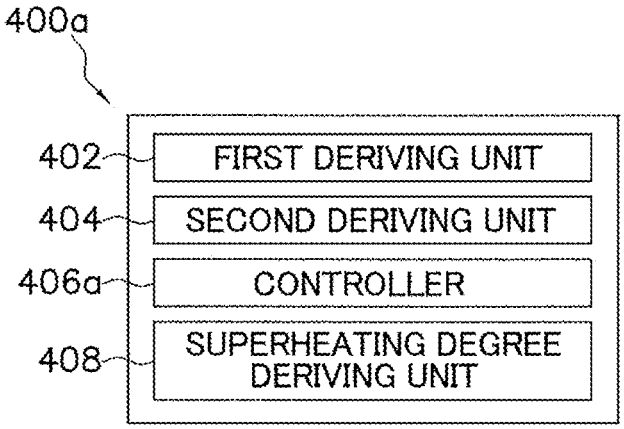
FIG. 9 is a block diagram of a control unit included in an air conditioner according to a modification example A, that particularly shows functional units relevant to control of a first suction return valve of a heat source unit.

Control to open or close the first suction return valve 162 by the control unit 400*a* flows similarly to the process of control depicted in FIG. 8 and described in the above embodiment, except that, if the quantity A2 of the refrigerant expected to be supplied to the cooling heat exchanger 160 when the first suction return valve 162 is opened is larger than the quantity A1 of the liquid refrigerant evaporable in the cooling heat exchanger 160 when the refrigerant is supplied to the cooling heat exchanger 160 in step S6, the process does not return directly to step S2 but proceeds to step S10 and step S20, and the process may proceed to step S7 in accordance with a determination result in step S20. Description is accordingly made to only step S10 and step S20.

If the quantity A2 of the refrigerant expected to be supplied to the cooling heat exchanger 160 when the first suction return valve 162 is opened is determined as being more than the quantity A1 of the liquid refrigerant evaporable in the cooling heat exchanger 160 when the refrigerant is supplied to the cooling heat exchanger 160 in step S6, the process proceeds to step S10

In step S10, the control unit 400*a* calculates an expected degree of superheating of the refrigerant at the suction side of the compressor 110 when the refrigerant is supplied to the cooling heat exchanger 160. Such processing in step S10 will be described in detail with reference to the flowchart in FIG. 11.

In step S11, the controller 406*a* calculates quantity (expected quantity) of the refrigerant not evaporating in the cooling heat exchanger 160 and flowing into the suction pipe 110*a* when the refrigerant is supplied to the cooling heat exchanger 160. Specifically, the controller 406*a* calculates the quantity of the refrigerant not evaporating in the cooling heat exchanger 160 and flowing into the suction pipe 110*a* by subtracting the quantity A1 of the liquid refrigerant evaporable in the cooling heat exchanger 160 when the refrigerant is supplied to the cooling heat exchanger 160 from the quantity A2 of the refrigerant expected to be supplied to the cooling heat exchanger 160 when the first suction return valve 162 is opened.

Subsequently in step S12, the controller 406*a* calculates quantity of the refrigerant returning from each of the utilization units 300 to the suction pipe 110*a* in accordance with the number of rotations of the compressor 110, the opening degrees of the flow-rate control valves 150 and 320, or the like. Specifically, the control unit 400*a* includes a memory storing information on a relation between quantity of the refrigerant circulating in the refrigerant circuit 50 and the number of rotations of the compressor 110, the opening degrees of the flow-rate control valves 150 and 320, and the like. The controller 406*a* calculates quantity of the refrigerant circulating in the refrigerant circuit 50 in accordance with the number of rotations of the compressor 110, the opening degrees of the flow-rate control valves 150 and 320, or the like, with reference to the information stored in the memory of the control unit 400*a*. The controller 406*a* further calculates the quantity of the refrigerant returning from each of the utilization units 300 to the suction pipe 110*a* by subtracting, from the quantity of the refrigerant circulating in the refrigerant circuit 50, quantity of the refrigerant bypassing the second suction return pipe 170*a* or the like and flowing into the suction pipe 110*a* (e.g. quantity of the refrigerant calculated from the opening degree of the second suction return valve 172 and the pressure difference ΔP between the first pressure Pr1 and the second pressure Pr2). In a case where the refrigerant does not flow through the second suction return pipe 170*a* or the like (where the refrigerant does not bypass), the controller 406*a* may regard the quantity of the refrigerant circulating in the refrigerant circuit 50 as the quantity of the refrigerant returning from each of the utilization units 300 to the suction pipe 110*a*.

Subsequently in step S13, the superheating degree deriving unit 408 calculates a degree of superheating of the refrigerant returning from the utilization unit 300 to the suction pipe 110*a*.

Subsequently in step S14, the controller 406*a* assesses whether or not the refrigerant that is obtained after mixing the refrigerant flowing out of the cooling heat exchanger 160 and the refrigerant returning from the utilization unit 300 and that flows toward the compressor 110 comes into the wet state in accordance with the degree of superheating and the quantity of the refrigerant returning from each of the utilization units 300 to the suction pipe 110*a*, quantity of heat needed to evaporate the liquid refrigerant of the quantity calculated in step S11, or the like. Specifically in this case, the controller 406*a* calculates the degree of superheating (the expected degree of superheating) of the refrigerant that is obtained after mixing the refrigerant flowing out of the cooling heat exchanger 160 and the refrigerant returning from the utilization unit 300 and that flows toward the compressor 110 when the refrigerant is supplied to the cooling heat exchanger 160.

The control unit 400*a* then completes the processing in step S10.

Subsequently in step S20, the controller 406*a* compares the expected degree of superheating calculated in step S10 (step S14) with a target degree of superheating, assesses that the refrigerant flowing from the cooling heat exchanger 160 toward the compressor 110 (after joining the refrigerant flowing from the utilization unit 300 toward the compressor 110) does not come into the wet state in a case where the expected degree of superheating is equal to or more than the target degree of superheating, and determines to open the first suction return valve 162. The process then proceeds to step S7. In another case where the expected degree of superheating is less than the target degree of superheating, the controller 406 keeps the first suction return valve 162 closed (i.e. does not open the first suction return valve 162). The process then proceeds to step S2. The target degree of superheating preferably has a positive value, or may alternatively be zero.

In the air conditioner according to the modification example A, the controller 406*a* assesses whether or not the refrigerant that is obtained after mixing the refrigerant flowing out of the cooling heat exchanger 160 and the refrigerant returning from the utilization unit 300 and that flows toward the compressor 110 comes into the wet state when the refrigerant is supplied with the cooling heat exchanger 160, and determines whether or not to open the first suction return valve 162 in accordance with an assessment result.

In this case, whether or not to open the first suction return valve 162 configured to switch to supply or not to supply the cooling heat exchanger 160 with the refrigerant is determined in accordance with the assessment result as to whether or not the refrigerant that is obtained after mixing the refrigerant flowing out of the cooling heat exchanger 160 and the refrigerant returning from the utilization unit 300 and that flows toward the compressor 110 comes into the wet state. The cooling heat exchanger 160 may thus be occasionally supplied with the refrigerant even under the condition where the refrigerant immediately after flowing out of the cooling heat exchanger 160 comes into the wet state. The cooling heat exchanger 160 in the present air conditioner 10 is accordingly applicable under a wider condition.

The air conditioner according to the modification example A includes the first deriving unit 402 and the second deriving unit 404. The first deriving unit 402 derives the first pressure Pr1 upstream of the first suction return valve 162 in the refrigerant flow direction F of the refrigerant flowing to the cooling heat exchanger 160 when the first suction return valve 162 is opened. The second deriving unit 404 derives the second pressure Pr2 downstream of the cooling heat exchanger 160 in the refrigerant flow direction F. The controller 406*a* determines whether or not to open the first suction return valve 162 in accordance with the pressure difference ΔP between the first pressure Pr1 and the second pressure Pr2 and the quantity of the refrigerant returning from the utilization unit 300.

In this case, whether or not to open the first suction return valve 162 is determined in accordance with highly accurate assessment as to whether or not the refrigerant flowing toward the compressor 110 comes into the wet state with reference to the pressure difference ΔP between the first pressure Pr1 and the second pressure Pr2 correlated with the quantity of the refrigerant flowing in the cooling heat exchanger 160 when the first suction return valve 162 is opened, as well as the quantity of the refrigerant returning from the utilization unit 300. The air conditioner 10 thus achieves high reliability in which the occurrence of liquid compression can be reduced.

The modification example A provides a refrigeration apparatus including the casing internal temperature sensor Ta and the superheating degree deriving unit 408. The casing internal temperature sensor Ta measures temperature in the casing 106. The superheating degree deriving unit 408 derives the degree of superheating of the refrigerant returning from the utilization unit 300. The controller 406*a* determines whether or not to open the first suction return valve 162 in accordance with the temperature in the casing 106 and the degree of superheating of the refrigerant returning from the utilization unit 300.

In this case, whether or not to open the first suction return valve 162 is determined in accordance with highly accurate assessment as to whether or not the refrigerant flowing toward the compressor 110 comes into the wet state with reference to the temperature in the casing 106 correlated with the quantity of heat supplied to the refrigerant in the cooling heat exchanger 160 as well as the degree of superheating of the refrigerant returning from the utilization unit 300. The air conditioner 10 thus achieves high reliability in which the occurrence of liquid compression can be reduced.

(6-2) Modification Example B

The modification example A provides calculation of the degree of superheating of the refrigerant returning from each of the utilization units 300 to the suction side of the compressor 110 in accordance with the degree of superheating at outlets of the utilization heat exchanger 310 in each of the utilization units 300A and 300B and the heat source-side heat exchanger 140 in the heat source unit 100A as well as the quantity balance between the refrigerants flowing in the heat exchangers 310 and 140. The present invention should not be limited to this configuration.

For example, the superheating degree deriving unit 408 may alternatively calculate the degree of superheating of the refrigerant returning from the utilization unit 300 to the suction side of the compressor 110 in accordance with the sucked refrigerant temperature sensor T2 provided adjacent to an inlet of the accumulator 124 and the evaporation temperature in the refrigeration cycle obtained from measurement values of the low pressure sensor P2. This case enables calculation of a current degree of superheating of the refrigerant flowing into the compressor 110 inclusive of the refrigerant bypassing the second suction return pipe 170*a* or the like and flowing into the suction pipe 110*a*. The controller 406*a* can calculate a degree of superheating (an expected degree of superheating) of the refrigerant that is obtained after mixing the refrigerant flowing out of the cooling heat exchanger 160 and the refrigerant returning from the utilization unit 300 and that flows toward the compressor 110 when the refrigerant is supplied to the cooling heat exchanger 160, in accordance with the current degree of superheating of the refrigerant flowing into the compressor 110, current quantity of the refrigerant circulating in the refrigerant circuit 50 calculated from the number of rotations of the compressor 110, the opening degrees of the flow-rate control valves 150 and 320, or the like, and quantity of the refrigerant not evaporating in the cooling heat exchanger 160 and flowing into the suction pipe 110*a* when the refrigerant is supplied to the cooling heat exchanger 160.

(6-3) Modification Example C

The heat source unit 100 according to the above embodiment utilizes water as the heat source. The present invention should not be limited to this configuration. The heat source of the heat source unit 100 may alternatively be air.

(6-4) Modification Example D

The air conditioner 10 according to the above embodiment includes the connection units 200, to allow part of the utilization units 300 to execute cooling operation and allow the remaining utilization unit 300 to execute heating operation. The present invention should not be limited to this configuration. The air conditioner exemplifying the refrigeration apparatus according to the present invention may not be configured to execute simultaneous cooling and heating operation.

(6-5) Modification Example E

The cooling heat exchanger 160 according to the above embodiment is supplied with air having cooled the electric components 104. The present invention should not be limited to this configuration. The air conditioner 10 may further include a fan provided separately from the fan 166 configured to guide air to the electric components 104, and the fan may be configured to supply the cooling heat exchanger 160 with air in the casing 106.

(6-6) Modification Example F

The first suction return pipe 160*a* according to the above embodiment is provided with the first suction return valve 162 configured as an electromagnetic valve and the capillary 164. In the case where the first suction return pipe 160*a* is provided with the motor valve having a controllable opening degree in place of the first suction return valve 162 and the capillary 164, the memory of the control unit 400 preferably stores information on a relation between the pressure difference ΔP between the first pressure Pr1 and the second pressure Pr2 when the motor valve is controlled to have a predetermined opening degree, and a flow rate of a liquid refrigerant flowing in the cooling heat exchanger 160, and the controller 406 preferably calculates a flow rate from the calculated pressure difference ΔP in accordance with the information.

(6-7) Modification Example G

If the refrigerant flowing from the cooling heat exchanger 160 toward the compressor 110 is assessed as being in the wet state in accordance with a sensor measurement result after the first suction return valve 162 is opened in step S7 in the flowchart in FIG. 8, the controller 406 may be configured to close the first suction return valve 162 even in a case where a condition in step S8 is not satisfied.

(6-8) Modification Example H

The controller 406 according to the above embodiment assesses whether or not the refrigerant comes into the wet state before the cooling heat exchanger 160 is used. The controller 406 may assess the wet state in accordance with a method similar to the assessment method described above after the first suction return valve 162 is opened to use the cooling heat exchanger 160, and may adopt an assessment result as a condition for closing the first suction return valve 162.

In this case, the first suction return valve 162 may be controlled to close not in accordance with the above assessment method but in accordance with a degree of superheating obtained as a difference between a measurement value of a temperature sensor provided downstream of the cooling heat exchanger 160 (provided on the first suction return pipe 160*a* and downstream of the cooling heat exchanger 160 in the refrigerant flow direction F) and low-pressure saturation temperature of the refrigerant (e.g. low-pressure saturation temperature calculated from the measurement value of the low pressure sensor P2). Specifically, the controller 406 may control to close the first suction return valve 162 when the degree of superheating as the difference between the measurement value of the temperature sensor provided downstream of the cooling heat exchanger 160 and the low-pressure saturation temperature of the refrigerant is equal to or less than a predetermined value.

INDUSTRIAL APPLICABILITY

The present invention provides a highly reliable refrigeration apparatus that can reduce the cause of the liquid compression.

REFERENCE SIGNS LIST 10 air conditioner (refrigeration apparatus)
50 refrigerant circuit
100(100A,100B) heat source unit
106 casing
110 compressor
110*a* suction pipe
140 heat source-side heat exchanger (main heat exchanger)

160 cooling heat exchanger
160*a* first suction return pipe (pipe)
162 first suction return valve (valve)
300(300A,300B) utilization unit
310 utilization heat exchanger
402 first deriving unit
404 second deriving unit
406, 406*a* controller
408 superheating degree deriving unit
Pr1 first pressure
Pr2 second pressure
ΔP pressure difference (pressure difference between first pressure and second pressure)
Ta casing internal temperature sensor (temperature measurement unit)

CITATION LIST

Patent Literature

Patent Literature 1: JPH8-049884 A

The invention claimed is:

1. A refrigeration apparatus comprising:

a heat source unit including a compressor configured to compress a refrigerant, a main heat exchanger configured to cause heat exchange between the refrigerant and a heat source, a casing accommodating the compressor and the main heat exchanger, a cooling heat exchanger supplied with the refrigerant and configured to cool an interior of the casing, and a valve configured to switch to supply or not to supply the cooling heat exchanger with the refrigerant;

a utilization unit including a utilization heat exchanger, the utilization unit and the heat source unit constituting a refrigerant circuit;

a first sensor configured to detect a temperature or a pressure of the refrigerant flowing in the refrigerant circuit upstream of the valve in a refrigerant flowing direction flowing to the cooling heat exchanger when the valve is opened;

a second sensor configured to detect a temperature or a pressure of the refrigerant flowing in the refrigerant circuit downstream of the cooling heat exchanger in the refrigerant flowing direction; and a controller configured to control to open or close the valve, wherein the controller is configured to:

derive first pressure upstream of the valve in the refrigerant flow direction, based on a detection result of the first sensor in accordance with information on a relation between temperature and pressure of a refrigerant stored in a memory of the controller in a case where the first sensor is a temperature sensor or based on a detection result of the first sensor in a case where the first sensor is a pressure sensor;

derive second pressure downstream of the cooling heat exchanger in the refrigerant flow direction, based on a detection result of the second sensor in accordance with information on a relation between temperature and pressure of a refrigerant stored in a memory of the controller in a case where the second sensor is a temperature sensor or based on a detection result of the first sensor in a case where the second sensor is a pressure sensor;

assess, before the valve is opened to supply the cooling heat exchanger with the refrigerant, whether or not the refrigerant flowing from the cooling heat exchanger toward the compressor comes into a wet state when the refrigerant is supplied to the cooling heat exchanger based on a pressure difference between the first pressure and the second pressure; and determine whether or not to open the valve in accordance with an assessment result.

2. The refrigeration apparatus according to claim 1, wherein the controller is further configured to:

assess whether or not the refrigerant supplied to the cooling heat exchanger entirely comes into a gaseous state immediately after flowing out of the cooling heat exchanger based on the pressure difference between the first pressure and the second pressure; and determine whether or not to open the valve in accordance with the assessment result.

3. The refrigeration apparatus according to claim 1, further comprising a temperature sensor configured to measure temperature in the casing, wherein the controller is further configured to determine whether or not to open the valve also in accordance with the temperature detected by the temperature sensor.

4. The refrigeration apparatus according to claim 1, wherein the controller is further configured to:

assess whether or not the refrigerant that is obtained after mixing the refrigerant flowing out of the cooling heat exchanger and the refrigerant returning from the utilization unit and that flows toward the compressor comes into the wet state when the refrigerant is supplied with the cooling heat exchanger based on the pressure difference between the first pressure and the second pressure and the quantity of the refrigerant returning from the utilization unit; and determine whether or not to open the valve in accordance with an assessment result.

5. The refrigeration apparatus according to claim 4, further comprising:

a temperature sensor configured to measure temperature in the casing, wherein the controller is further configured to:

derive a degree of superheating of the refrigerant returning from the utilization unit based on the detection result of the temperature sensor; and determine whether or not to open the valve also in accordance with the temperature and the degree of superheating.

6. The refrigeration apparatus according to claim 1, wherein the cooling heat exchanger is disposed on a pipe connecting a pipe connecting between the main heat exchanger and the utilization heat exchanger and a suction pipe of the compressor.

7. The refrigeration apparatus according to claim 1, wherein the heat source is water.

* * * * *